US007173382B2

(12) United States Patent
Ball

(10) Patent No.: US 7,173,382 B2
(45) **Date of Patent: *Feb. 6, 2007**

(54) NESTED BALANCING TOPOLOGY FOR BALANCING CURRENT AMONG MULTIPLE LAMPS

(75) Inventor: Newton E. Ball, Anaheim, CA (US)

(73) Assignee: Microsemi Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/095,313

(22) Filed: Mar. 31, 2005

(65) Prior Publication Data

US 2006/0220593 A1 Oct. 5, 2006

(51) Int. Cl.
*H05B 41/16* (2006.01)

(52) U.S. Cl. ..... 315/282; 315/277; 315/279

(58) Field of Classification Search ..... None
See application file for complete search history.

(56) References Cited

U.S. PATENT DOCUMENTS

| | | | |
|---|---|---|---|
| 2,429,162 | A | 10/1947 | Russell et al. |
| 2,440,984 | A | 5/1948 | Summers |
| 2,572,258 | A | 10/1951 | Goldfield et al. |
| 2,965,799 | A | 12/1960 | Brooks et al. |
| 2,968,028 | A | 1/1961 | Eilichi et al. |
| 3,141,112 | A | 7/1964 | Eppert |
| 3,597,656 | A | 8/1971 | Douglas |
| 3,611,021 | A | 10/1971 | Wallace |
| 3,737,755 | A | 6/1973 | Calkin et al. |
| 3,742,330 | A | 6/1973 | Hodges et al. |
| 3,936,696 | A | 2/1976 | Gray |
| 3,944,888 | A | 3/1976 | Clark |
| 4,060,751 | A | 11/1977 | Anderson |
| 4,388,562 | A | 6/1983 | Josephson |
| 4,463,287 | A | 7/1984 | Pitel |
| 4,523,130 | A | 6/1985 | Pitel |
| 4,572,992 | A | 2/1986 | Masaki |
| 4,574,222 | A | 3/1986 | Anderson |
| 4,622,496 | A | 11/1986 | Dattilo et al. |
| 4,630,005 | A | 12/1986 | Clegg et al. |
| 4,663,566 | A | 5/1987 | Nagano |
| 4,663,570 | A | 5/1987 | Luchaco et al. |
| 4,672,300 | A | 6/1987 | Harper |
| 2005/0225261 | A1* | 10/2005 | Jin ..... 315/255 |
| 2006/0022612 | A1 | 2/2006 | Henry |

(Continued)

FOREIGN PATENT DOCUMENTS

| | | |
|---|---|---|
| EP | 0647021 | 9/1994 |

(Continued)

*Primary Examiner*—Tuyet Thi Vo
(74) *Attorney, Agent, or Firm*—Knobbe, Martens, Olson & Bear, LLP.

(57) ABSTRACT

An apparatus and methods for balancing current in multiple negative impedance gas discharge lamp loads. Embodiments advantageously include balancing transformer configurations that are relatively cost-effective, reliable, and efficient. Embodiments include configurations that are applicable to an unrestrained number of gas discharge tubes, such as cold cathode fluorescent lamps. The balancing transformer configuration techniques permit a relatively small number of power inverters, such as one power inverter, to power multiple paralleled lamps or paralleled groups of lamps with balancing transformers coupling the lamps or groups of lamps in a zigzag topology. One embodiment of a balancing transformer includes a safety winding which can be used to protect the balancing transformer in the event of a lamp failure and can be used to provide an indication of a failed lamp.

20 Claims, 16 Drawing Sheets

U.S. PATENT DOCUMENTS 4,675,574 A 6/1987 Delflache
4,686,615 A 8/1987 Ferguson
4,698,554 A 10/1987 Stupp et al.
4,761,722 A 8/1988 Pruitt
4,766,353 A 8/1988 Burgess
4,780,696 A 10/1988 Jirka
4,847,745 A 7/1989 Shekhawat
4,862,059 A 8/1989 Tominaga et al.
4,939,381 A 7/1990 Shibata
5,023,519 A 6/1991 Jensen
5,030,887 A 7/1991 Guisinger
5,036,255 A 7/1991 McKnight et al.
5,057,808 A 10/1991 Dhyanchand
5,173,643 A 12/1992 Sullivan et al.
5,349,272 A 9/1994 Rector
5,434,477 A 7/1995 Crouse et al.
5,475,284 A 12/1995 Lester et al.
5,485,057 A 1/1996 Smallwood et al.
5,519,289 A 5/1996 Katyl et al.
5,539,281 A 7/1996 Shackle et al.
5,557,249 A 9/1996 Reynal
5,563,473 A 10/1996 Mattas et al.
5,574,335 A 11/1996 Sun
5,574,356 A 11/1996 Parker
5,615,093 A 3/1997 Nalbant
5,619,402 A 4/1997 Lin
5,621,281 A 4/1997 Kawabata et al.
5,652,479 A 7/1997 LoCascio et al.
5,712,776 A 1/1998 Palara et al.
5,754,012 A 5/1998 LoCascio et al.
5,818,172 A 10/1998 Lee
5,822,201 A 10/1998 Kijima
5,825,133 A 10/1998 Conway
5,828,156 A 10/1998 Roberts
5,892,336 A 4/1999 Lin et al.
5,910,713 A 6/1999 Nishi et al.
5,912,812 A 6/1999 Moriarty, Jr.
5,914,842 A 6/1999 Sievers
5,923,129 A 7/1999 Henry
5,930,121 A 7/1999 Henry
5,936,360 A 8/1999 Kaneko
6,002,210 A 12/1999 Nilssen
6,020,688 A 2/2000 Moisin
6,028,400 A 2/2000 Pol et al.
6,037,720 A 3/2000 Wong et al.
6,038,149 A 3/2000 Hiraoka et al.
6,040,662 A 3/2000 Asayama
6,043,609 A 3/2000 George et al.
6,049,177 A 4/2000 Felper
6,072,282 A 6/2000 Adamson
6,104,146 A 8/2000 Chou et al.
6,108,215 A 8/2000 Kates et al.
6,114,814 A 9/2000 Shannon et al.
6,121,733 A 9/2000 Nilssen
6,127,785 A 10/2000 Williams
6,127,786 A 10/2000 Moisin
6,137,240 A 10/2000 Bogdan
6,150,772 A 11/2000 Crane
6,169,375 B1 1/2001 Moisin
6,181,066 B1 1/2001 Adamson
6,181,083 B1 1/2001 Moisin
6,181,084 B1 1/2001 Lau
6,188,553 B1 2/2001 Moisin
6,198,234 B1 3/2001 Henry
6,198,236 B1 3/2001 O'Neill
6,215,256 B1 4/2001 Ju
6,218,788 B1 4/2001 Chen et al.
6,259,615 B1 7/2001 Lin
6,281,636 B1 8/2001 Okutsu et al.
6,281,638 B1 8/2001 Moisin
6,307,765 B1 10/2001 Choi
6,310,444 B1 10/2001 Chang
6,316,881 B1 11/2001 Shannon et al.
6,320,329 B1 11/2001 Wacyk
6,323,602 B1 11/2001 De Groot et al.
6,344,699 B1 2/2002 Rimmer
6,362,577 B1 3/2002 Ito et al.
6,396,722 B2 5/2002 Lin
6,417,631 B1 7/2002 Chen et al.
6,420,839 B1 7/2002 Chiang et al.
6,433,492 B1 8/2002 Buonauita
6,445,141 B1 9/2002 Kastner et al.
6,459,215 B1 10/2002 Nerone et al.
6,459,216 B1 10/2002 Tsai
6,469,922 B2 10/2002 Choi
6,472,827 B1 10/2002 Nilssen
6,472,876 B1 10/2002 Notohamiprodjo et al.
6,486,618 B1 11/2002 Li
6,494,587 B1 12/2002 Shaw et al.
6,501,234 B2 12/2002 Lin et al.
6,509,696 B2 1/2003 Bruning et al.
6,515,427 B2 2/2003 Oura et al.
6,515,811 B2 2/2003 Ikuhara et al.
6,531,831 B2 3/2003 Chou et al.
6,534,934 B1 3/2003 Lin et al.
6,559,606 B1 5/2003 Chou et al.
6,570,344 B2 5/2003 Lin
6,628,093 B2 9/2003 Stevens
6,633,138 B2 10/2003 Shannon et al.
6,717,372 B2 4/2004 Lin et al.
6,765,354 B2 7/2004 Klien
6,781,325 B2 8/2004 Lee
6,784,627 B2 8/2004 Suzuki et al.
6,804,129 B2 10/2004 Lin
6,870,330 B2 3/2005 Choi
6,922,023 B2 7/2005 Hsu et al.
6,936,975 B2 8/2005 Lin et al.
2001/0036096 A1 11/2001 Lin
2002/0030451 A1 3/2002 Moisin
2002/0097004 A1 7/2002 Chiang et al.
2002/0135319 A1 9/2002 Bruning et al.
2002/0140538 A1 10/2002 Yer
2002/0145886 A1 10/2002 Stevens
2002/0171376 A1 11/2002 Rust et al.
2002/0180380 A1 12/2002 Lin
2002/0180572 A1 12/2002 Kakehashi et al.
2002/0181260 A1 12/2002 Chou et al.
2002/0195971 A1 12/2002 Qian et al.
2003/0001524 A1 1/2003 Lin et al.
2003/0080695 A1 5/2003 Ohsawa
2003/0090913 A1 5/2003 Che-Chen et al.
2003/0117084 A1 6/2003 Stack
2003/0141829 A1 7/2003 Yu
2004/0032223 A1 2/2004 Henry
2004/0155596 A1 8/2004 Ushijima
2004/0257003 A1 12/2004 Hsieh et al.
2004/0263092 A1 12/2004 Liu
2005/0093471 A1 5/2005 Jin
2005/0093472 A1 5/2005 Jin
2005/0093482 A1 5/2005 Ball
2005/0093483 A1 5/2005 Ball
2005/0093484 A1 5/2005 Ball
2005/0094372 A1 5/2005 Jin
2005/0099143 A1 5/2005 Kohno

FOREIGN PATENT DOCUMENTS

JP 06168791 A 6/1994
JP 8-204488 8/1996
TW 554643 9/2003
WO WO 94/15444 7/1994

* cited by examiner

NESTED BALANCING TOPOLOGY FOR BALANCING CURRENT AMONG MULTIPLE LAMPS

RELATED APPLICATIONS

Applicant's copending U.S. Patent Application 10/095,294 entitled "Zigzag Topology for Balancing Current Among Paralleled Gas Discharge Lamps," filed on the same day as this application, is hereby incorporated by reference herein.

BACKGROUND

1. Field of the Invention

The invention generally relates to balancing electrical current in loads with a negative impedance characteristic. In particular, the invention relates to balancing electrical current used in driving multiple gas discharge tubes, such as multiple cold cathode fluorescent lamps (CCFLs).

2. Description of the Related Art

Cold cathode fluorescent lamps (CCFLs) are used in a broad variety of applications as light sources. For example, CCFLs can be found in lamps, in scanners, in backlights for displays, such as liquid crystal displays (LCDs), and the like. In recent years, the size of LCD displays has grown to relatively large proportions. Relatively large LCDs are relatively common in computer monitor applications, in flat-screen televisions, and in high-definition televisions. In these and many other applications, the use of multiple CCFLs is common. For example, a combination of six CCFLs is relatively common in a backlight for a desktop LCD computer monitor. In another example of a relatively-large flat-screen television, 16, 20, 32, and 40 CCFLs have been used. Of course, the number of CCFLs used in any particular application can vary in a very broad range.

Desirably, in applications with multiple CCFLs, the CCFLs are driven by relatively few power inverters to save size, weight, and cost. However, driving multiple CCFLs from a single or relatively few- power inverters is a relatively difficult task. When multiple CCFLs are coupled in series, the operating voltage required to light the series-coupled lamps increases to impractical levels. The increase in operating voltage leads to increased corona discharge, requires expensive high voltage insulation, and the like.

Coupling CCFLs in parallel provides other problems. While the operating voltage of paralleled lamps is desirably low, relatively even current balancing in paralleled CCFLs can be difficult to achieve in practice. CCFLs and other gas discharge tubes exhibit a negative impedance characteristic in that the hotter and brighter a particular CCFL tube runs, the lower its impedance characteristic and the higher its drawn current. As a result, when CCFLs are paralleled without balancing circuits, some lamps will typically be much brighter than other lamps. In many cases, some lamps will be on, while other lamps will be off. In addition to the drawbacks of uneven illumination, the relatively brighter lamps can overheat and exhibit a short life.

A two-way balancing transformer can be used to balance current in two CCFLs. This type of balancing transformer can be constructed from two relatively equal windings on the same core and is sometimes referred to in the art as a "balun" transformer, though it will be understood that the term "balun" applies to other types of transformers as well. While the two-way balancing transformer technique works well to balance current when both CCFLs are operating, when one of the two CCFLs fails, the differential voltage across the two-way balancing transformer can grow to very high levels. This differential voltage can damage conventional two-way balancing transformers. In addition, conventional configurations with two-way balancing transformers are limited to paralleling two CCFLs. Another drawback of conventional balancing transformer configurations is relatively inefficient suppression of electromagnetic interference (EMI).

SUMMARY

Embodiments advantageously include balancing transformer configurations that are relatively cost-effective, reliable, and efficient. Embodiments include configurations that are applicable to any number of gas discharge tubes, such as cold cathode fluorescent lamps. One application for cold cathode fluorescent lamps is backlighting a liquid crystal display. The balancing transformer configuration techniques permit a relatively small number of power inverters, such as one power inverter, to power multiple lamps in a parallel configuration. Traditionally, driving multiple lamps in a parallel configuration has been difficult due to the negative impedance characteristic of such loads.

One embodiment is a lamp assembly, which includes: a plurality of N lamps, where N is at least 3; and a plurality of N−1 balancing transformers. Each of the balancing transformers has two balancing windings operatively coupled in series with respective pairs of parallel lamps to balance current for the pairs of lamps. For example, first ends of a first pair of the plurality of N lamps are operatively coupled to a first one of the N−1 balancing transformers. Second ends of a second pair of the plurality of N lamps are operatively coupled to a second one of the N−1 balancing transformers. A lamp is common to the first pair and to the second pair, and the second end is opposite to the first end. Thus, the balancing transformers connect the lamps in a zigzag topology and current levels are balanced among the lamps.

In one embodiment, the lamp assembly further includes an additional N-th balancing transformer not of the plurality of N−1 balancing transformers, the N-th balancing transformer is operatively coupled in series with an N-th pair of lamps, where each of the lamps in the N-th pair is operatively coupled in series with only one of the N−1 balancing transformers.

One embodiment is a lamp assembly, which includes: a plurality of N lamps, where N is at least 3; and a plurality of N−1 balancing transformers to balance current for the plurality of N lamps, where the N−1 balancing transformers are operatively coupled to respective N−1 overlapping pairs of lamps such that one lamp is common to two of the N−1 balancing transformers that are operatively coupled to the common lamp at opposite ends of the common lamp.

One embodiment is a method of paralleling gas discharge lamps, where the method includes: providing a plurality of N lamps, where N is at least 3; balancing current among the plurality of N lamps with a group of N−1 balancing transformers, where a balancing transformer balances current between a pair of lamps, wherein a lamp in a first pair of lamps overlaps with a second pair of lamps so that a lamp is common to both pairs; and coupling the N−1 balancing transformers to ends of lamps in an alternating pattern so that balancing transformers of the N−1 balancing transformers that are operatively coupled to a common lamp are operatively coupled to opposite ends of the common lamp.

One embodiment is an arrangement of transformers for balancing current among a plurality of gas discharge lamp loads driven in parallel, where the arrangement includes: a plurality of N lamps, where N is at least 3; and means for balancing current among the plurality of N lamps with a group of N−1 balancing transformers operatively coupled at alternating ends of N−1 overlapping pairs of lamps.

One embodiment is a lamp assembly, which includes a plurality of N lamps comprising at least a first lamp, a second lamp, and a third lamp, each lamp having a first end and a second end; a first terminal and a second terminal adapted to receive power from an inverter for driving the plurality of N lamps in a parallel configuration; and a plurality of N−1 two-way balancing transformers disposed alternately between the first terminal and the first ends and between the second terminal and the second ends to balance current flowing through partially overlapping pairs of lamps.

In an example of three lamps, the first terminal is operatively coupled to the first end of the third lamp and the second terminal is operatively coupled to the second end of the first lamp. A first two-way balancing transformer is disposed in a current path between the first terminal and first ends of the first lamp and the second lamp, where the first two-way balancing transformer is configured to balance current flowing through the first lamp and the second lamp; and a second two-way balancing transformer is disposed in a current path between the second terminal and second ends of the second lamp and the third lamp, where the second two-way balancing transformer is configured to balance current flowing through the second lamp and the third lamp.

One embodiment is a method of paralleling gas discharge lamps, where the method includes: providing a plurality of at least 3 lamps; and placing two-way balancing transformers at alternate ends of partially overlapping pairs of lamps to provide current matching among the lamps. For example, current within a first pair of lamps is balanced with a first two-way balancing transformer; and current within a second pair of lamps is balanced with a second two-way balancing transformer, wherein one lamp in the second pair is common with the first pair.

One embodiment is a method of paralleling gas discharge lamps, where the method includes: providing a plurality of lamps each having a first end and a second end; and arranging a plurality of two-way balancing transformers in a zigzag pattern so that an n-th lamp and an (n+1)-th lamp are operatively coupled to a two-way balancing transformer at first ends, and so that the (n+1)-th lamp and an (n+2)-th lamp are operatively coupled to another two-way balancing transformer at second ends.

One embodiment is a method of balancing current among a plurality of gas discharge lamp loads driven in parallel, where the method includes: distributing current evenly between a first gas discharge lamp load and a second gas discharge lamp load with a first two-way balancing transformer; and distributing current evenly between the second gas discharge lamp load and a third gas discharge lamp load with a second two-way balancing transformer.

One embodiment is an arrangement of transformers for balancing current among a plurality of gas discharge lamp loads driven in parallel, where the arrangement includes: means for distributing current evenly between a first gas discharge lamp load and a second gas discharge lamp load with a first two-way balancing transformer; and means for distributing current evenly between the second gas discharge lamp load and a third gas discharge lamp load with a second two-way balancing transformer.

One embodiment is a lamp assembly, which includes: a plurality of N lamps in a parallel configuration, where N is at least 3; a plurality of N balancing transformers with balance windings operatively coupled in series with select lamps, wherein: N−1 balancing transformers are arranged in a zigzag topology such that the N−1 balancing transformers are arranged at alternate ends of partially overlapping pairs of lamps; and an N-th balancing transformer coupled to the first and last lamps such that each of the plurality of N lamps is in series with the same number of balancing transformer windings.

One embodiment is a method of paralleling gas discharge lamps, where the method includes: providing a plurality of at least 3 lamps; balancing current within a first pair of lamps with a first balancing transformer operatively coupled to first ends of the first pair of lamps; balancing current within a second pair of lamps with a second two-way balancing transformer operatively coupled to second ends of the second pair of lamps, wherein one lamp in the second pair is common with the first pair; and balancing current within a third pair of lamps with a third balancing transformer operatively coupled in series with the third pair of lamps, where the third pair includes a lamp from the first pair and a lamp from the second pair of lamps.

One embodiment is a method of paralleling gas discharge lamps, where the method includes: providing a plurality of N lamps, where N is at least 3; and balancing current among the plurality of N lamps with N balancing transformers, wherein at least one balancing transformer is operatively coupled to an opposite end of a lamp than another balancing transformer.

One embodiment is a method of paralleling gas discharge lamps, where the method includes: providing a plurality of N lamps, where N is at least 3; and providing N balancing transformers, wherein: N−1 balancing transformers balance current for pairs of lamps, wherein the N−1 balancing transformers are arranged in a zigzag topology such that the N−1 balancing transformers are arranged at alternate ends of partially overlapping pairs of lamps; and an N-th balancing transformer arranged such that each of the plurality of N lamps is in series with the same number of balancing transformer windings.

One embodiment is a method of paralleling gas discharge lamps, where the method includes: providing a plurality of N lamps, where N is at least 3; and balancing current among the plurality of N lamps with N balancing transformers, wherein the N balancing transformers further comprise N−1 balancing transformers and an extra balancing transformer, wherein: a first portion of the N−1 balancing transformers are operatively coupled to first ends of the plurality of N lamps and are configured to balance current in one or more first pairs of lamps; a second portion of the N−1 balancing transformers are operatively coupled to second ends of at least a portion of the plurality of N lamps and are configured to balance current for one or more second pairs of lamps, where the one or more first pairs of lamps and the one or more second pairs of lamps overlap but are not identical; and an extra balancing transformer arranged such that each of the plurality of N lamps is in series with the same number of balancing transformer windings.

One embodiment is an arrangement of transformers for balancing current among a plurality of gas discharge lamp loads driven in parallel, where the arrangement includes: means for providing a plurality of N lamps, where N is at least 3; and means for balancing current among the plurality of N lamps with N balancing transformers, wherein at least one balancing transformer is operatively coupled to an opposite end of a lamp than another balancing transformer.

In one embodiment, lamps are organized into groups (e.g., N lamp groups) in a multi-lamp assembly. Each lamp group includes at least two lamps arranged in a lamp subassembly that is coupled between two group ends. At least N−1 outer-level balancing transformers are coupled to the N lamp groups in a zigzag configuration to balance current among the lamp groups. For example, each outer-level balancing transformer is substantially similar to the two-way balancing transformer described above and includes two balance windings for coupling to two different lamp groups to balance current between the two different lamp groups. The N−1 outer-level balancing transformers are respectively coupled to N−1 partially overlapping sets of two lamp groups at alternating group ends such that each lamp group is coupled to at least one outer-level balancing transformer and each group end of at least N−2 lamp groups is coupled to an outer-level balancing transformer. In one embodiment, N outer-level balancing transformers are coupled to the N lamp groups such that each group end of the N lamp groups is coupled to an outer-level balancing transformer.

In one embodiment, at least one lamp group includes one or more inner-level balancing transformers to balance current among lamps in the same lamp group. For example, M lamps of the same lamp group can be coupled to M−1 inner level balancing transformers in an open zigzag configuration, M inner-level balancing transformers in a closed zigzag configuration, or M respective inner-level balancing transformers arranged in a ring balancing configuration. Other balancing configurations (e.g., tree configurations, string configurations or the like) are also possible. In the ring balancing configuration, each lamp is coupled in series with a primary winding of a different inner-level balancing transformer and secondary windings of the inner-level balancing transformers are coupled in a serial loop. In one embodiment, the outer-level balancing transformers are substantially identical to each other and the inner-level balancing transformers are substantially identical to each other.

In one application, 20 lamps are organized into five groups of four lamps. Four inner-level balancing transformers balance current among the four lamps in each lamp group. In one embodiment, the four inner-level balancing transformers are coupled to the four lamps in a closed zigzag configuration. For example, a first inner-level balancing transformer is coupled to first ends (or terminals) of a first lamp and a second lamp, a second inner-level balancing transformer is coupled to second ends of the second lamp and a third lamp, a third inner-level balancing transformer is coupled to first ends of the third lamp and a fourth lamp, and a fourth inner-level balancing transformer is coupled to second ends of the fourth lamp and the first lamp.

In one embodiment, four outer-level balancing transformers are coupled to the five lamp groups in an open zigzag configuration to balance current among the lamp groups. For example, a first outer-level balancing transformer is coupled to first group ends of a first lamp group and a second lamp group, a second outer-level balancing transformer is coupled to second group ends of the second lamp group and a third lamp group, a third outer-level balancing transformer is coupled to first group ends of the third lamp group and a fourth lamp group, and a fourth inner-level balancing transformer is coupled to second group ends of the fourth lamp group and a fifth lamp group.

In another application, 20 lamps are organized into four groups of five lamps. In one embodiment, each lamp group includes a set of four inner-level balancing transformers coupled to the five lamps in an open zigzag configuration to balance current among lamps of the same lamp group. In another embodiment, each lamp group includes a set of five inner-level balancing transformers arranged in a ring balancing configuration to balance current among the five lamps. The zigzag configurations and the ring balancing configuration advantageously can balance an even or an odd number of lamps or lamp groups. In the ring balancing configuration or other configurations that couple inner-level balancing transformers to the same ends of the respective lamps within a lamp group, the inner-level balancing transformers can be coupled to alternate ends of lamps for different lamp groups and lamps of different lamp groups can be interleaved in a display panel such that adjacent lamps have respective inner-level balancing transformers at opposite ends of the lamps to minimize uneven brightness.

In one embodiment, four outer-level balancing transformers are coupled to the four lamp groups in a closed zigzag configuration to balance current among the lamp groups. For example, a first outer-level balancing transformer is coupled to first group ends of a first lamp group and a second lamp group, a second outer-level balancing transformer is coupled to first group ends of a third lamp group and a fourth lamp group, a third outer-level balancing transformer is coupled to second group ends of the first lamp group and the third lamp group, and a fourth outer-level balancing transformer is coupled to second group ends of the second lamp group and the fourth lamp group.

In yet another application, 16 lamps are organized into four groups of four lamps. Each lamp group includes a set of four inner-level balancing transformers coupled to the four lamps in a closed zigzag configuration. Four outer-level balancing transformers are coupled to the four lamp groups in a closed zigzag configuration as well.

For purposes of summarizing the invention, certain aspects, advantages and novel features of the invention have been described herein. It is to be understood that not necessarily all such advantages may be achieved in accordance with any particular embodiment of the invention. Thus, the invention may be embodied or carried out in a manner that achieves or optimizes one advantage or group of advantages as taught herein without necessarily achieving other advantages as may be taught or suggested herein.

BRIEF DESCRIPTION OF THE DRAWINGS

These drawings and the associated description herein are provided to illustrate embodiments and are not intended to be limiting.

DETAILED DESCRIPTION OF EMBODIMENTS

Although particular embodiments are described herein, other embodiments, including embodiments that do not provide all of the benefits and features set forth herein, will be apparent to those of ordinary skill in the art.

Embodiments include balancing transformer configurations that are relatively cost-effective, reliable, and efficient. Embodiments include configurations that are applicable to any number of gas discharge tubes. The balancing transformer configuration techniques permit a relatively small number of power inverters, such as one power inverter, to power multiple lamps in parallel. Traditionally, driving multiple lamps has been difficult due to the negative impedance characteristic of such loads. The balancing techniques disclosed herein advantageously permit paralleled lamps to "start" or light up relatively quickly and maintain relatively well-balanced current during operation. Embodiments are applicable to a wide variety of negative-impedance gas discharge lamps, including, but not limited to, cold-cathode fluorescent lamps (CCFLs), hot-cathode fluorescent lamps, neon lamps, and the like.

Zigzag Topology With 3 Lamps

Figure 1:
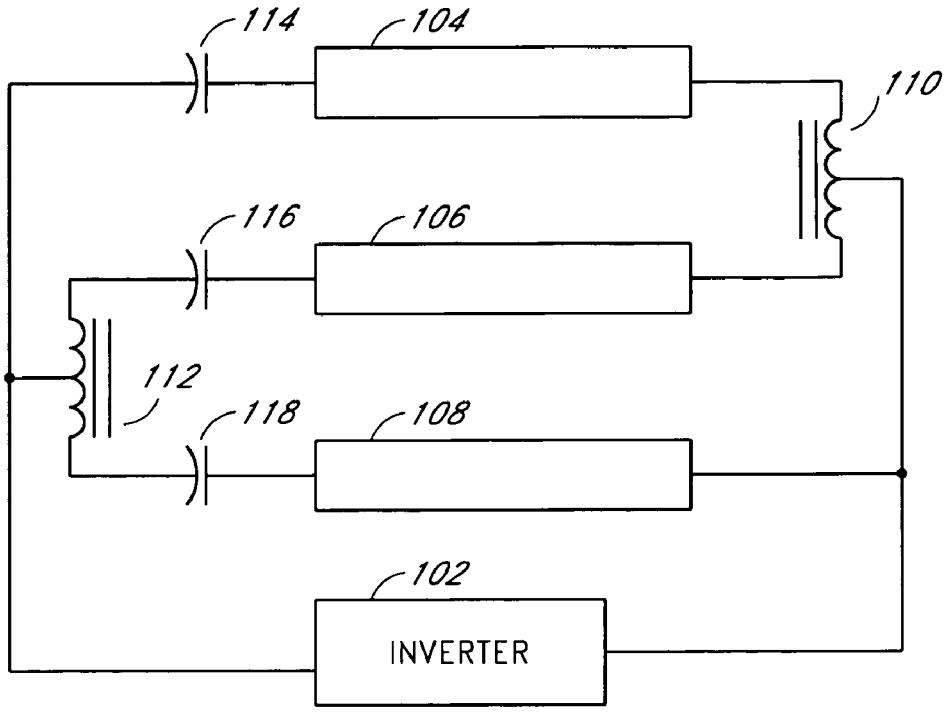
FIG. 1 illustrates a configuration of 3 gas-discharge lamps and 2 two-way balancing transformers arranged in a zigzag topology.
Figure 3:
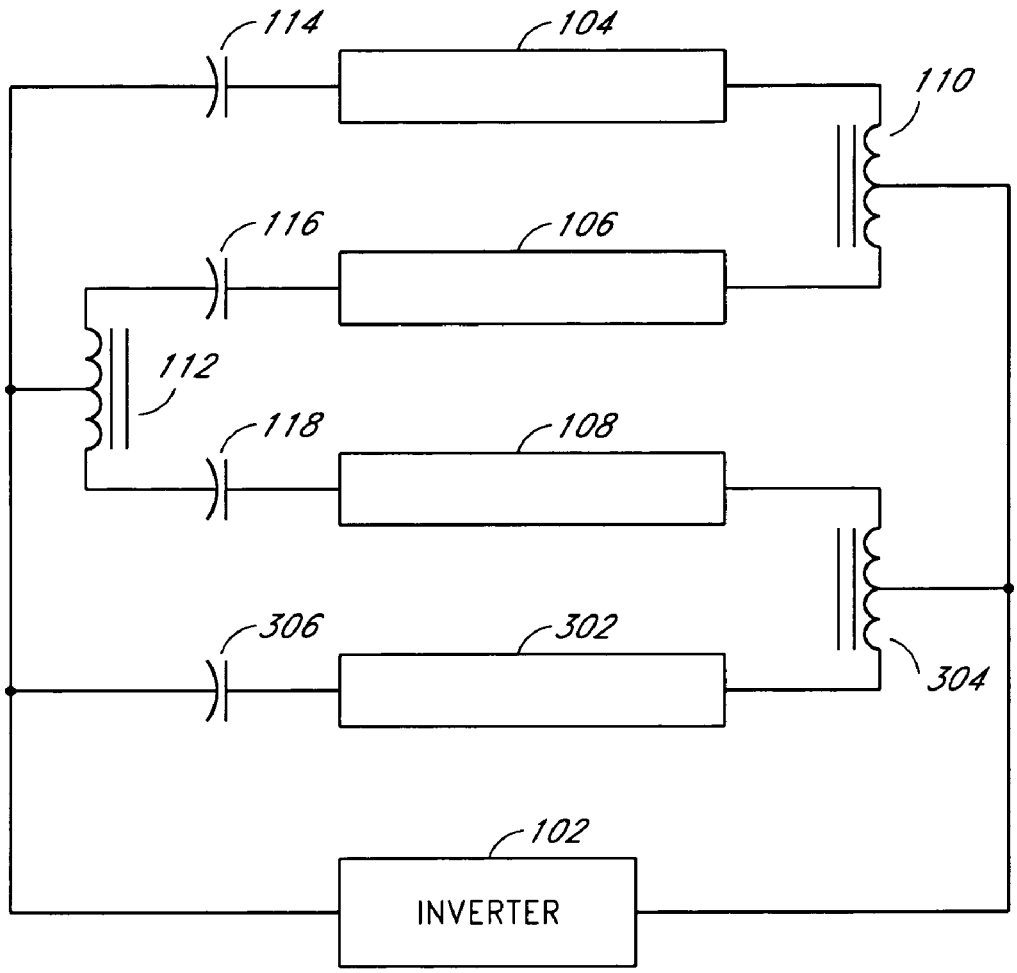
FIG. 3 illustrates a configuration of 4 gas-discharge lamps and 3 two-way balancing transformers arranged in a zigzag topology.
Figure 4:
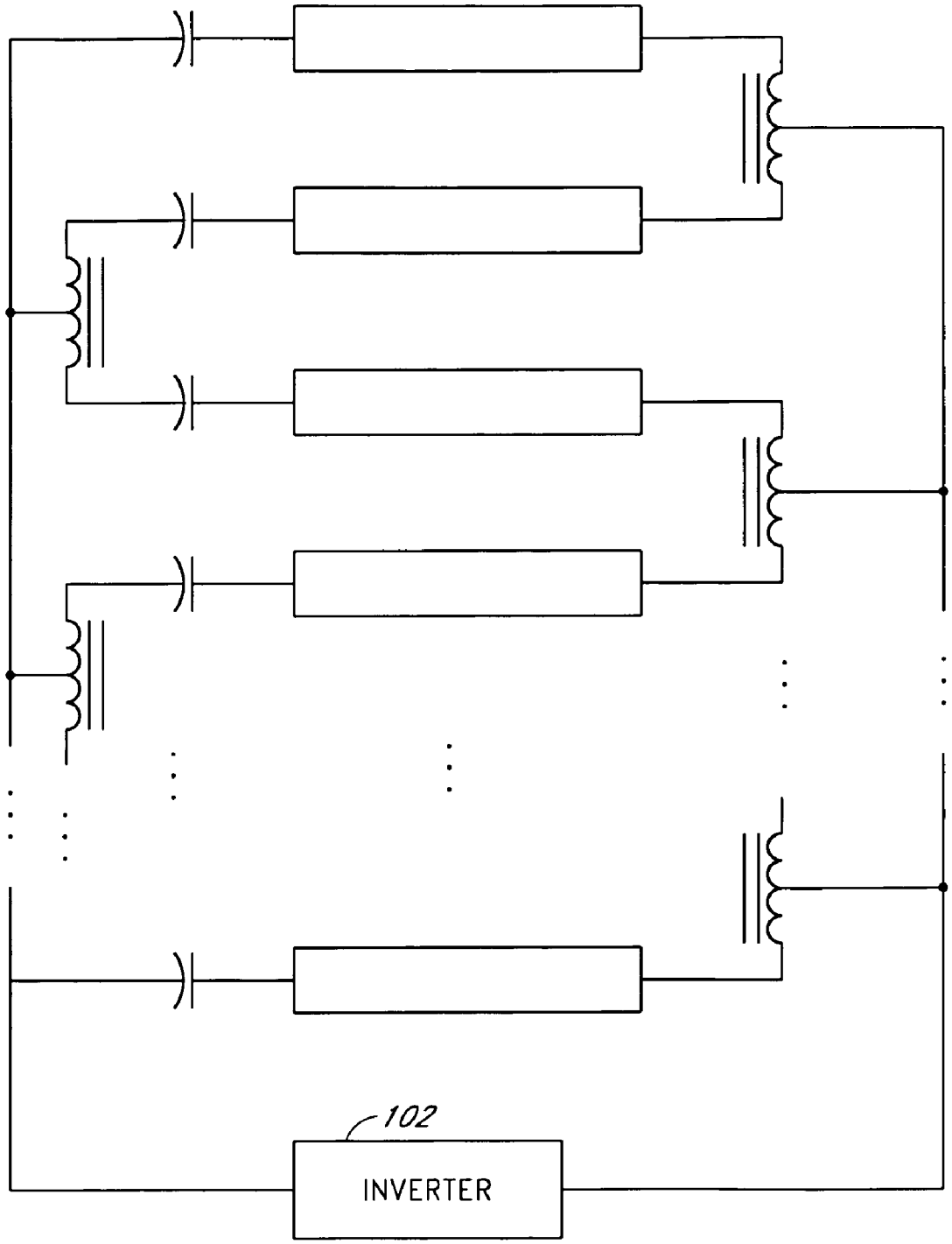
FIG. 4 illustrates a configuration of N gas-discharge lamps and N−1 two-way balancing transformers arranged in a zigzag topology.

FIG. 1 illustrates a configuration of 3 gas-discharge lamps and 2 two-way balancing transformers arranged in a zigzag or staggered topology. The zigzag topology can be used to parallel 3 or more lamps. In contrast to a simple hierarchical or "simple tree" topologies, the zigzag topology can be used to balance current in an arbitrary number of lamps, such as 3 lamps, 4 lamps, 5 lamps, 6 lamps and so on. FIG. 3 illustrates an example of the zigzag topology for 4 lamps. FIG. 4 illustrates an example of the zigzag topology for N lamps and N−1 two-way balancing transformers. It will be understood that for relatively large values of M total lamps that are paralleled in a relatively large array of lamps, that the N lamps paralleled by the disclosed techniques can correspond to a subset of the M total lamps.

Further advantageously, the two-way balancing transformers used in the zigzag topology each carry the current of one lamp in each balancing winding. This advantageously permits substantially identical two-way balancing transformers to be used throughout the configuration. When substantially identical balancing transformers can be used, this provides economies of scale, reduces the inventory of parts, reduces the chances of errors in assembly, and the like. By. contrast, in a hierarchical balancing transformer system, the balancing transformers that are relatively high in the hierarchy carry more current than the balancing transformers that are relatively low in the hierarchy and accordingly should have larger (lower gauge) wire in the balancing windings to carry the additional current.

The zigzag topology permits a plurality of lamps to be driven in parallel with relatively few inverters, such as with one inverter. This advantageously saves cost and space as inverter circuitry is typically much more expensive and takes up more space than balancing transformers. Typically, a secondary winding of an inverter transformer drives the paralleled lamps and associated balancing circuitry. For clarity, the output drive of an inverter is illustrated in the figures as an inverter 102, and various examples of inverters will be described later in connection with FIGS. 2A, 2B, and 2C.

In the illustrated zigzag configuration of FIG. 1, a first lamp 104, a second lamp 106, and a third lamp 108 are driven in parallel by the inverter 102. A first two-way balancing transformer 110 is electrically coupled to a first terminal of the inverter 102, and a second two-way balancing transformer 112 is electrically coupled to a second terminal of the inverter 102. The first two-way balancing transformer 110 is electrically coupled to the first lamp 104 and to the second lamp 106 and balances currents for the same. The second two-way balancing transformer 112 is electrically coupled to an opposite end of the second lamp 106 and to the third lamp 108 and balances currents for the same. Since the current flowing through the first lamp 104 is balanced with the current flowing through the second lamp 106, which in turn is balanced with the current flowing through the third lamp 108, the currents flowing through all three lamps 104, 106, 108 are well balanced.

In one embodiment, capacitors 114, 116, 118 are disposed in series with the lamps. These capacitors 114, 116, 118 are optional and can enhance lamp life by ensuring that the lamps are not exposed to direct current (DC). These capacitors 114, 116, 118 can be disposed in the current path at either end of a lamp and even further upstream, such as between a balancing transformer and the inverter 102. In one example with CCFLs, the capacitors 114, 116, 118 are prewired to the CCFLs in a backlight assembly. An example of a source of DC is a rectification circuit on the secondary side (the lamp side) used to estimate current in a lamp, such as a CCFL. These rectification circuits are typically referenced to ground. Depending on the control chip, these rectification circuits can be used to provide feedback to the control chip as to an amount of current flowing through the lamps. It will also be understood by the skilled practitioner that other components, such as other capacitors, inductors, ferrite beads, and the like, can also be included.

Two-Way Balancing Transformer

In one embodiment, a two-way balancing transformer has a first balancing winding and a second balancing winding wound on separate portions of a bobbin, and the balancing windings are commonly connected at one end to form the two-way balancing transformer. The electrical connection can be made within the transformer or outside the transformer, such as on a printed wiring board. Of course, the balancing windings should be connected with the proper polarity to balance current for the lamps flowing through the balancing windings. It will be understood that each of the balancing windings of a balancing transformer should have about the same number of turns. In one embodiment, with N lamps and N−1 balancing transformers, the number of turns of each winding of a balancing transformer should be within about one percent. In one embodiment, with N lamps and N balancing transformers, the balancing transformers should have substantially the same number of turns to avoid circulating currents. In addition, it should be noted that a plurality of balancing transformers can be fabricated in a single package.

One embodiment of a two-way balancing transformer includes a safety winding. The safety winding can be coupled to a protection circuit, such as anti-parallel diodes. The safety winding and protection circuit protect the two-way balancing transformer from over voltage conditions that can occur when the two-way balancing transformer is unable to balance current, such as when a lamp fails. The safety winding can also be used with a balancing transformer with two separate balancing windings that are not commonly connected at one end. The safety winding should have relatively few turns compared to the balancing winding, and it will be understood that the number of turns will vary greatly depending on the turns ratio desired. In one embodiment, the balancing windings have about 250 turns each, and the safety winding has one or two turns. In one embodiment, the safety winding is an isolated winding and is also insulated from the balancing windings so that the voltage induced in the safety winding can be safely monitored for fault detection.

In one example, where one paralleled lamp is "on" and another is "off," the anti-parallel diodes clamp the voltage at the safety winding, thereby clamping the voltage on the balancing windings. This situation frequently occurs upon startup of paralleled CCFLs. Clamping of the voltage advantageously prevents damage to the balancing transformer by limiting the maximum voltage across the balancing windings to a safe level. In one example, where a winding ratio is about 250:1 between a balancing winding and the safety winding, the anti-parallel diodes clamp at about 0.9 volts (for relatively large amounts of current), and limit the voltage across a balancing winding to about 225 volts.

The voltage on the safety winding can also be sensed by the control circuit and corrective measures, such as a reduction in current on the primary side so as not to overload the remaining lamps, an indication of a failure, a shut down of the power to the primary side, and the like, can be provided. Of course, it will be appreciated that upon immediate start up, the paralleled lamps may not start simultaneously. In one embodiment, the control circuit is configured to ignore imbalances for a predetermined time period at start up, such as a time period of about one-third of a second to about 3 seconds. It will be understood that this time period can vary in a very large range.

One embodiment of a two-way balancing transformer with separate balancing windings, a safety winding, and anti-parallel diodes will be described later in connection with FIG. 5. In addition, these and other features of a two-way balancing transformer that can be used are described in commonly-owned U.S. patent application Ser. No. 10/970,248, filed on Oct. 20, 2004, titled "Systems And Methods For Fault Protection In A Balancing Transformer," the disclosure of which is incorporated by reference in its entirety herein.

Inverter Configurations

Figure 2A:
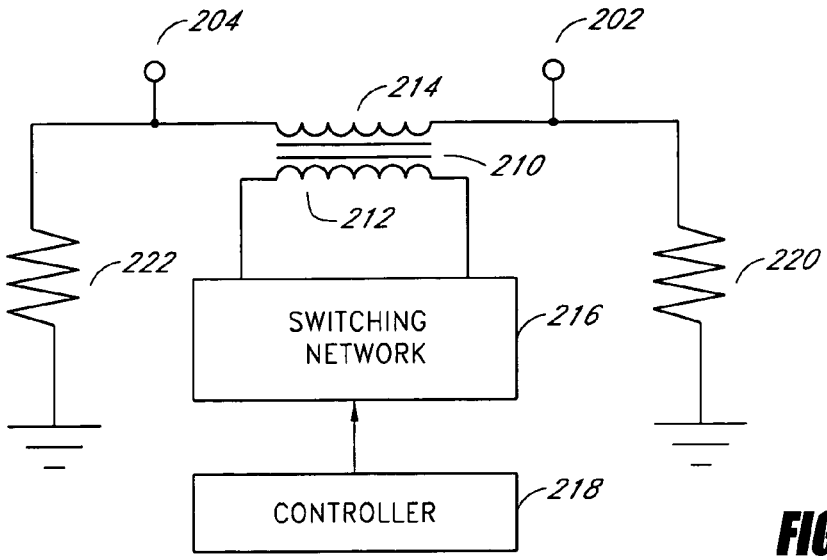
FIG. 2A illustrates an example of a floating output from an inverter.
Figure 2B:
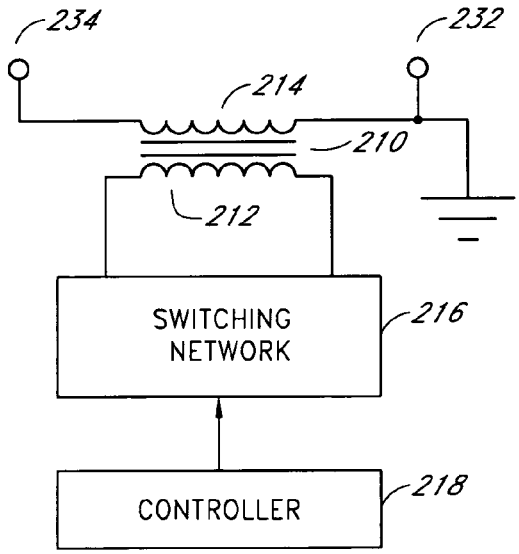
FIG. 2B illustrates an example of a single-ended output from an inverter.
Figure 2C:
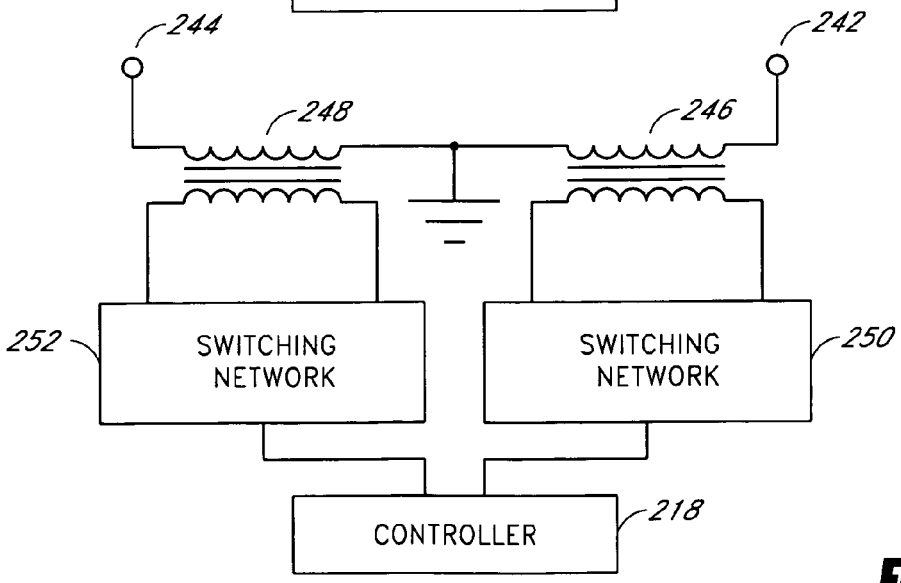
FIG. 2C illustrates an example of a double-ended or balanced output from an inverter.

A very broad variety of inverter configurations can be used to provide power to the paralleled lamps. For example, FIGS. 2A, 2B, and 2C illustrate examples of inverter configurations. It will be understood by one of ordinary skill in the art that applicable inverter configurations are not limited to the examples illustrated.

FIG. 2A illustrates a floating configuration for an output of an inverter. A paralleled lamp assembly can be electrically coupled to a first terminal 202 and a second terminal 204 to receive power. The floating configuration advantageously permits a peak voltage differential between a component on the secondary side (the lamp side) and a backplane for a backlight, which is typically grounded, to be relatively lower, thereby reducing the possibility of corona discharge.

An inverter transformer 210 couples power from a primary winding 212 to a secondary winding 214. The primary winding 212 is electrically coupled to a switching network 216, which is controlled by a controller 218. Typically, the switching network 216 and the controller 218 are powered from a direct current (DC) power source, and the switching network 216 is controlled by driving signals from the controller 136, and the switching network 216 generates a power alternating current (AC) signal for the inverter transformer 210. The switching network 216 can correspond to a very broad variety of circuits, such as, but not limited to, full bridge circuits, half-bridge circuits, push-pull circuits, Royer circuits, and the like.

In one embodiment, the inverter transformer 210 is relatively tightly coupled from the primary winding 212 to the secondary winding 214, and the controller 218 regulates current flow for lamps on the secondary side by monitoring primary-side current, rather than secondary-side current. This advantageously permits the secondary winding 214 to be floating with respect to ground as shown in the illustrated embodiment.

The illustrated embodiment of FIG. 2A also includes one or more optional relatively high-resistance value resistors 220, 222 to ground to discharge static charges. It will be understood that such high-value resistors do not change the floating nature of the circuit. An example of an applicable value of resistance is 10 megaohms. This value is not critical and other values will be readily determined by one of ordinary skill in the art.

FIG. 2B illustrates an example of a single-ended output from an inverter. A paralleled lamp assembly can be electrically coupled to a first terminal 232 and a second terminal 234 to receive power. In the illustrated embodiment, the first terminal 232 is grounded and the second terminal 234 is considered the "high" side. In another embodiment, the second terminal 234 is grounded and the first terminal 232 is the "high" side. One advantage of the single-ended output is that since the secondary output is referenced to ground, the secondary currents can be monitored relatively easily. One disadvantage is that peak voltages on the "high" side are relatively high, which increases the risk of corona discharge.

FIG. 2C illustrates an example of a double-ended output or balanced output from an inverter. Advantageously, this configuration provides relatively low peak voltage differentials between a component on the secondary side and ground. A paralleled lamp assembly can be electrically coupled to a first terminal 242 and a second terminal 244 to receive power. In the illustrated embodiment, two separate inverter transformers 246, 248 are driven by switching networks 250, 252 and are used to drive the lamps in a balanced or "split phase" manner. In the illustrated configuration, the common connection between the two inverter transformers 246, 248 is grounded to provide a balanced drive. In another configuration, the common connection between the two inverter transformers 246, 248 is not grounded, so that the first terminal 242 and a second terminal 244 are floating with respect to ground. See, for example, commonly-owned U.S. patent application Ser. No. 10/903,636 filed on Jul. 30, 2004, titled "Split Phase Inverters For CCFL Backlight System," the disclosure of which is hereby incorporated by reference herein in its entirety. Other techniques will be readily determined by one of ordinary skill in the art.

Zigzag Topology With N Lamps and With N−1 Lamps

FIG. 3 illustrates a configuration of 4 gas -discharge lamps and 3 two-way balancing transformers arranged in a zigzag or staggered topology. One advantage of the zigzag topology is that approximately the same current is carried in each balancing winding of a two-way balancing transformer. This advantageously permits substantially identical two-way balancing transformers to be used throughout the configuration.

In the embodiment illustrated in FIG. 3, a fourth lamp 302, a third two-way balancing transformer 304, and an optional capacitor 306 have been added to the embodiment described earlier in connection with FIG. 1. The optional capacitor 306 prevents the fourth lamp 302 from experiencing life-degrading direct current (DC). The third two-way balancing transformer 304 is electrically coupled to the first terminal of the inverter 102 and is further electrically coupled to the third lamp 108 and the fourth lamp 302 to balance current between the same. Since the first lamp 104 and the second lamp 106 are balanced by the first two-way balancing transformer 110, the second lamp 106 and the third lamp 108 are balanced by the second two-way balancing transformer 112, and the third lamp 108 and the fourth lamp 302 are balanced by the third two-way balancing transformer 304, the currents flowing through all four lamps are advantageously well balanced.

FIG. 4 illustrates a configuration of N gas-discharge lamps and N−1 two-way balancing transformers arranged in a zigzag topology. As illustrated by FIGS. 1, 3, and 4, as additional lamps and balancing transformers are added, added balancing transformers are coupled to the opposite ends of the lamps from a previous balancing transformer to form the zigzag configuration. As illustrated, balancing transformers drawn to the right of FIG. 4 are each operatively coupled to first ends of pairs of lamps and balance current within each corresponding pair of lamps. Balancing transformers drawn to the left of FIG. 4 are operatively coupled to second ends of alternating pairs of lamps than are the lamps balanced by the balancing transformers drawn to the right of FIG. 4. By having a lamp in common between pairs in an overlapping pattern between the pairs, the balancing of current can be achieved with relatively simple two-way balancing transformers. Advantageously, virtually any practical number of lamps can be balanced by the zigzag topology, and further advantageously, substantially identical two-way balancing transformers can be used throughout the configuration.

Figure 5:
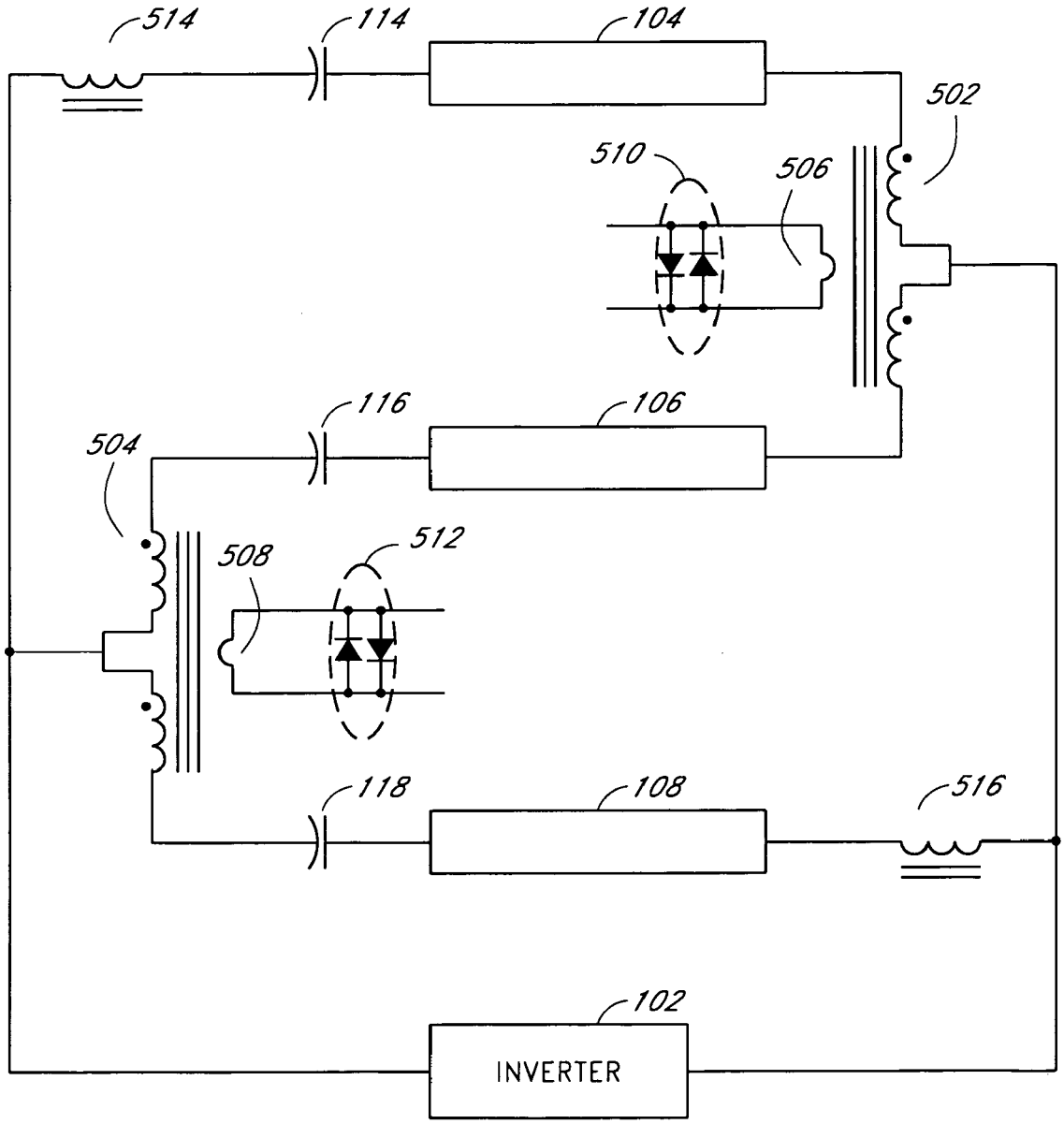
FIG. 5 illustrates a configuration with a zigzag topology with selected optional features.

FIG. 5 illustrates a configuration with a zigzag topology with selected optional features. The illustrated embodiment corresponds to a zigzag topology with 3 gas-discharge lamps. It will be understood that the principles and advantages of the optional features are applicable to configurations with any number of lamps. Each of the two-way balancing transformers 502, 504 illustrated in FIG. 5 has separate balancing windings that are commonly connected at one end to form the two-way balancing transformer. In addition, the two-way balancing transformers 502, 504 each have safety windings 506, 508, which are coupled to respective pairs of anti-parallel diodes 510, 512 for protection against imbalances. The safety windings 506, 508 can further be coupled to a fault detection circuit for monitoring.

Optional inductors 514, 516 can also be used. One disadvantage to the zigzag topology for N lamps and N−1 two-way balancing transformers is that the number of windings in series with a lamp can vary within the configuration. For example, the first lamp 104 and the third lamp 108 in a 3 lamp system have one balancing winding in series. By contrast, the second lamp 106 has two balancing windings in series. This creates a difference in leakage inductance in series with a lamp, which can affect the current balancing. In addition, to suppress EMI, it is desirable to place inductance, such as the leakage inductance of a balancing transformer, at both ends of a lamp. In one embodiment, the optional inductors 514, 516 are used to balance the leakage inductance and to suppress EMI by compensating for the absence of a balancing winding in series with a lamp. These inductors can be used in the configurations previously described herein.

Zigzag Topologies with N Lamps and N Balancing Transformers

FIGS. 6–9 illustrate embodiments of paralleled lamps with balancing transformers in a zigzag topology with N lamps and N balancing transformers. In a zigzag topology with N lamps and N balancing transformers, each of the N−1 balancing transformers balance current for overlapping pairs of lamps. The N-th balancing transformer corresponds to a redundant or extra transformer, which provides further balancing of leakage inductance. Advantageously, each lamp in a zigzag configurations with N lamps and N balancing transformers is in series with same number of balancing windings of balancing transformers. This permits the leakage inductance of the balancing transformers, which is additive in series with the lamps, to be relatively well balanced on a lamp-by-lamp basis.

Figure 6:
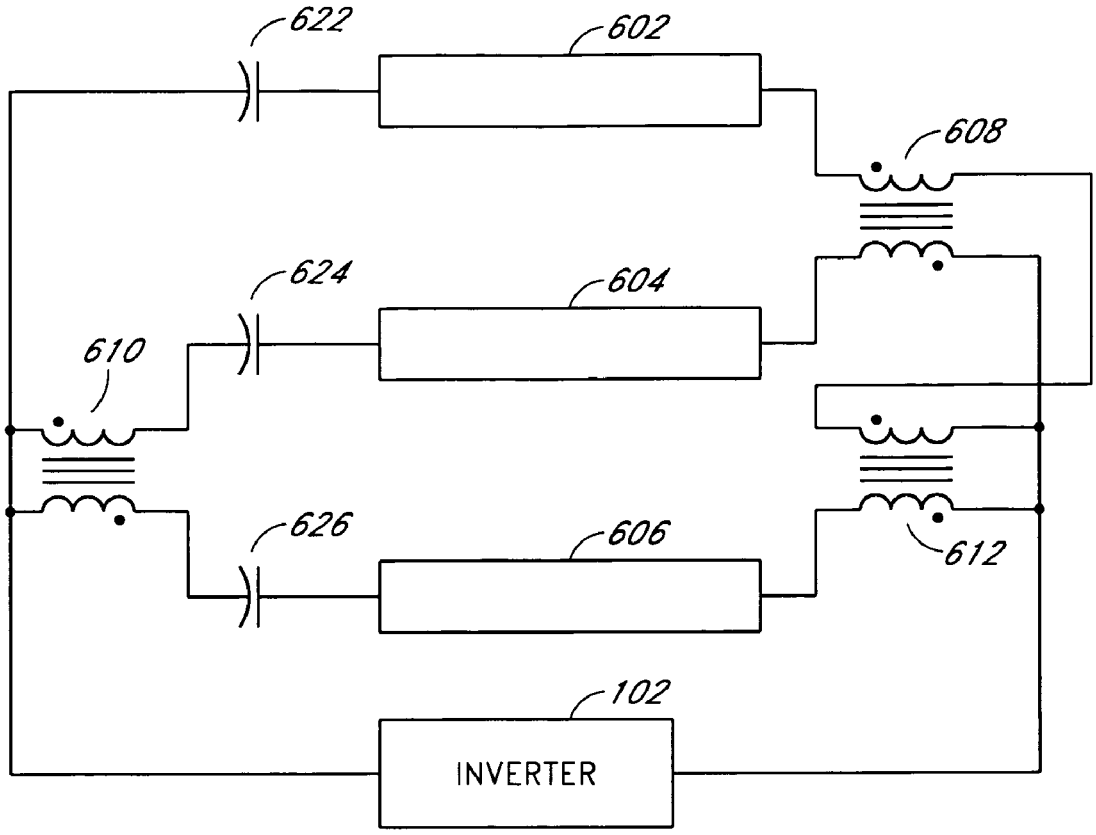
FIG. 6 illustrates a zigzag topology configuration of 3 gas-discharge lamps and 3 balancing transformers, which provides approximately the same leakage inductance to the lamps.
Figure 7A:
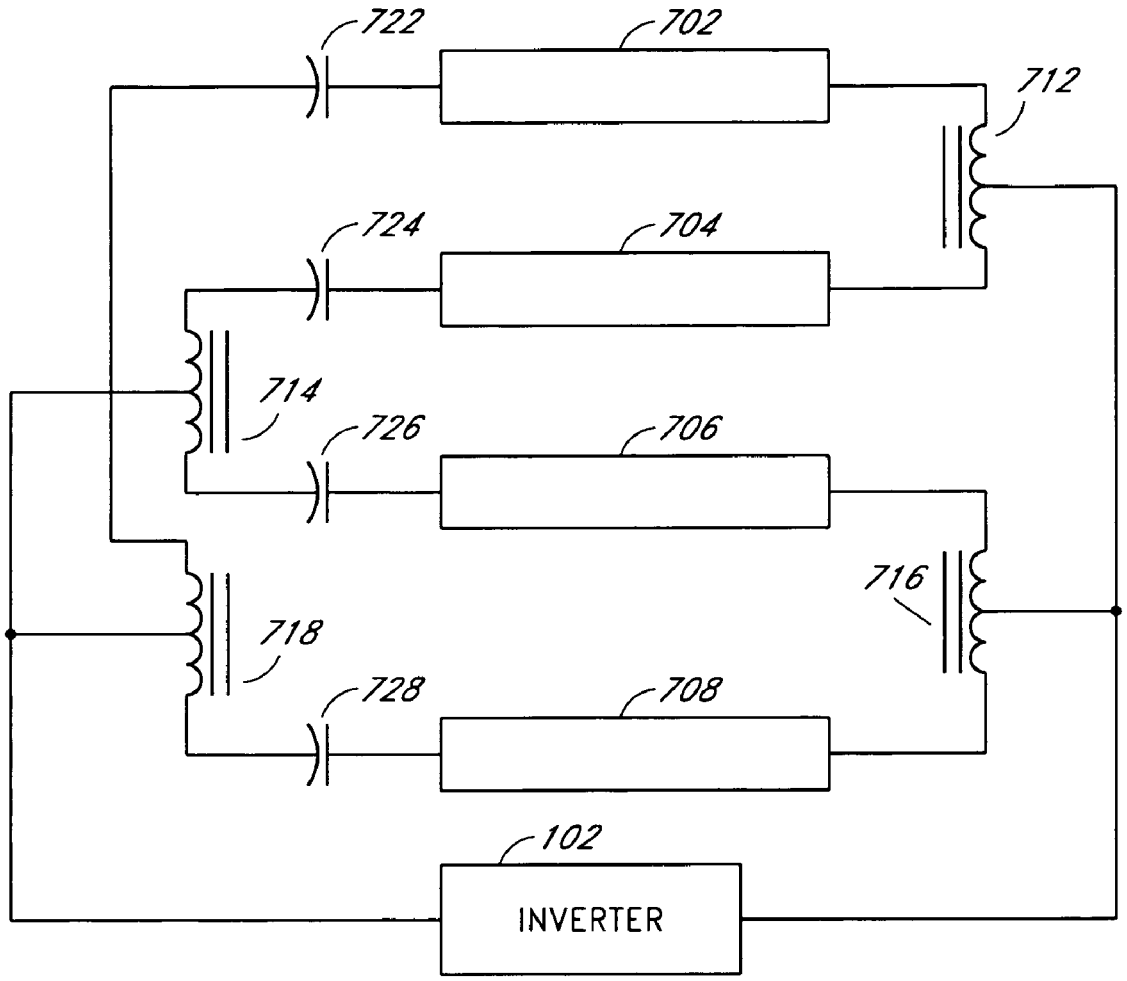
FIG. 7A illustrates a zigzag topology configuration of 4 gas-discharge lamps and 4 balancing transformers, which provides approximately the same leakage inductance to the lamps and provides additional suppression of electromagnetic interference (EMI).
Figure 7B:
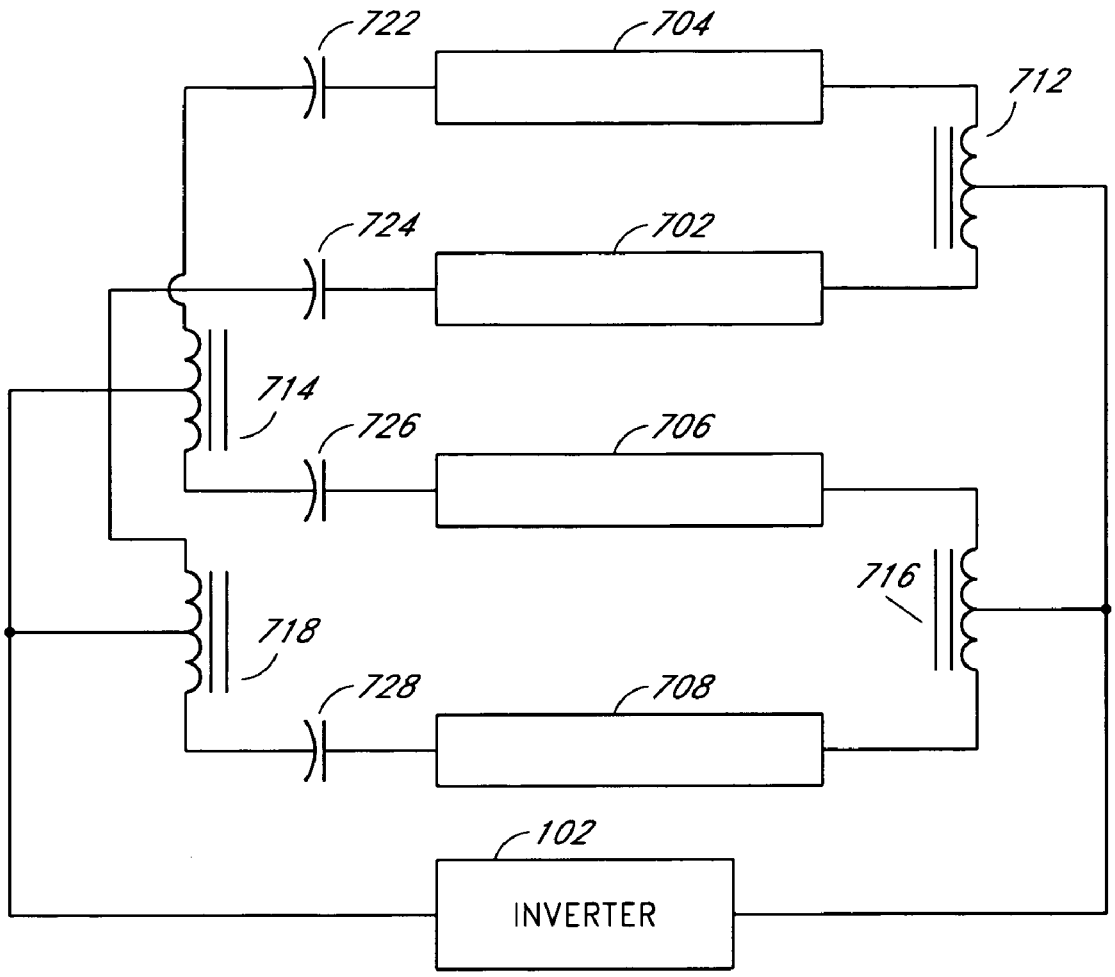
FIG. 7B illustrates an alternate embodiment of a zigzag topology configuration of 4 gas -discharge lamps and 4 balancing transformers.
Figure 8:
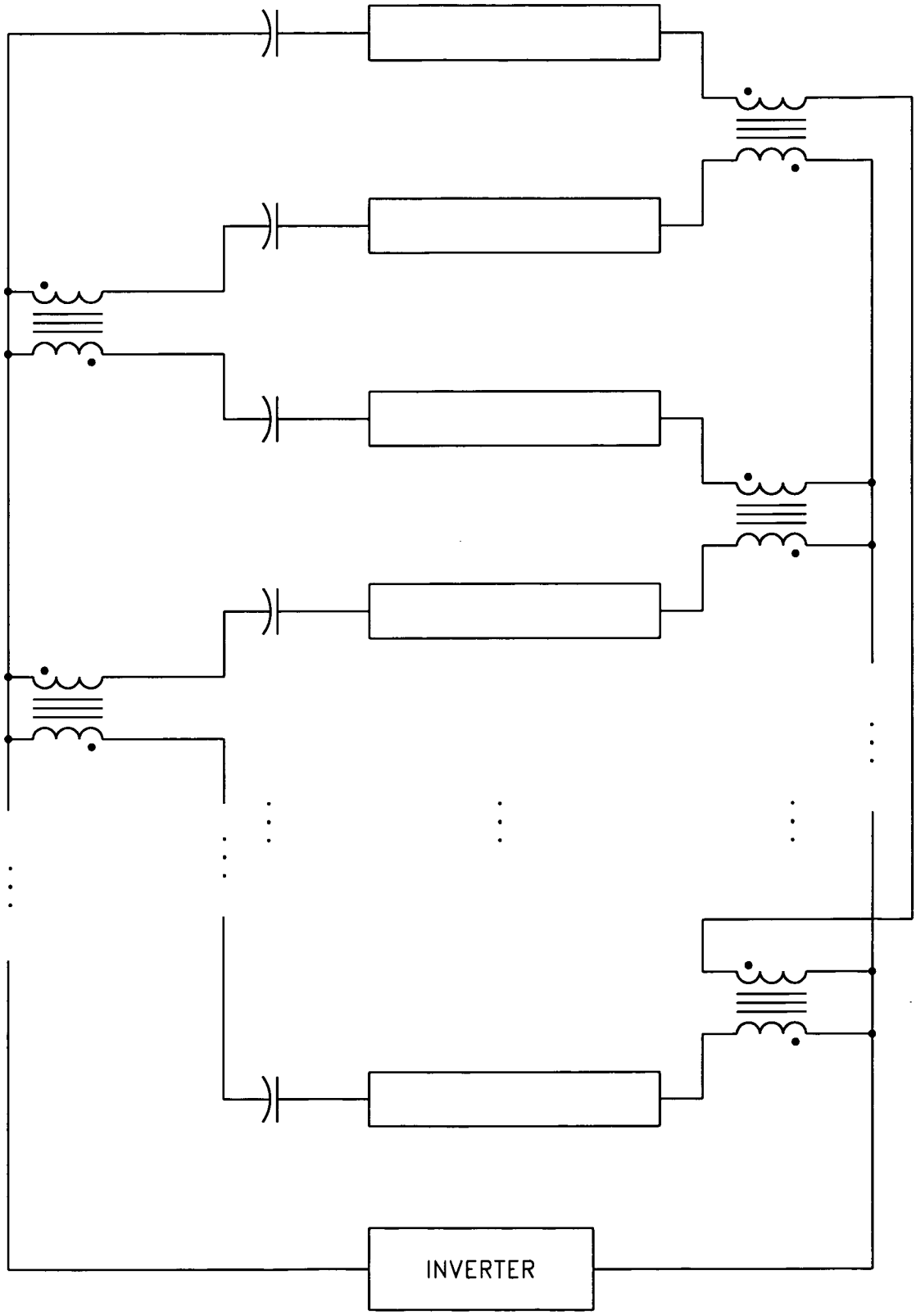
FIG. 8 illustrates a zigzag topology configuration of N gas-discharge lamps and N balancing transformers, which provides approximately the same leakage inductance to the lamps, where N is odd.
Figure 9A:
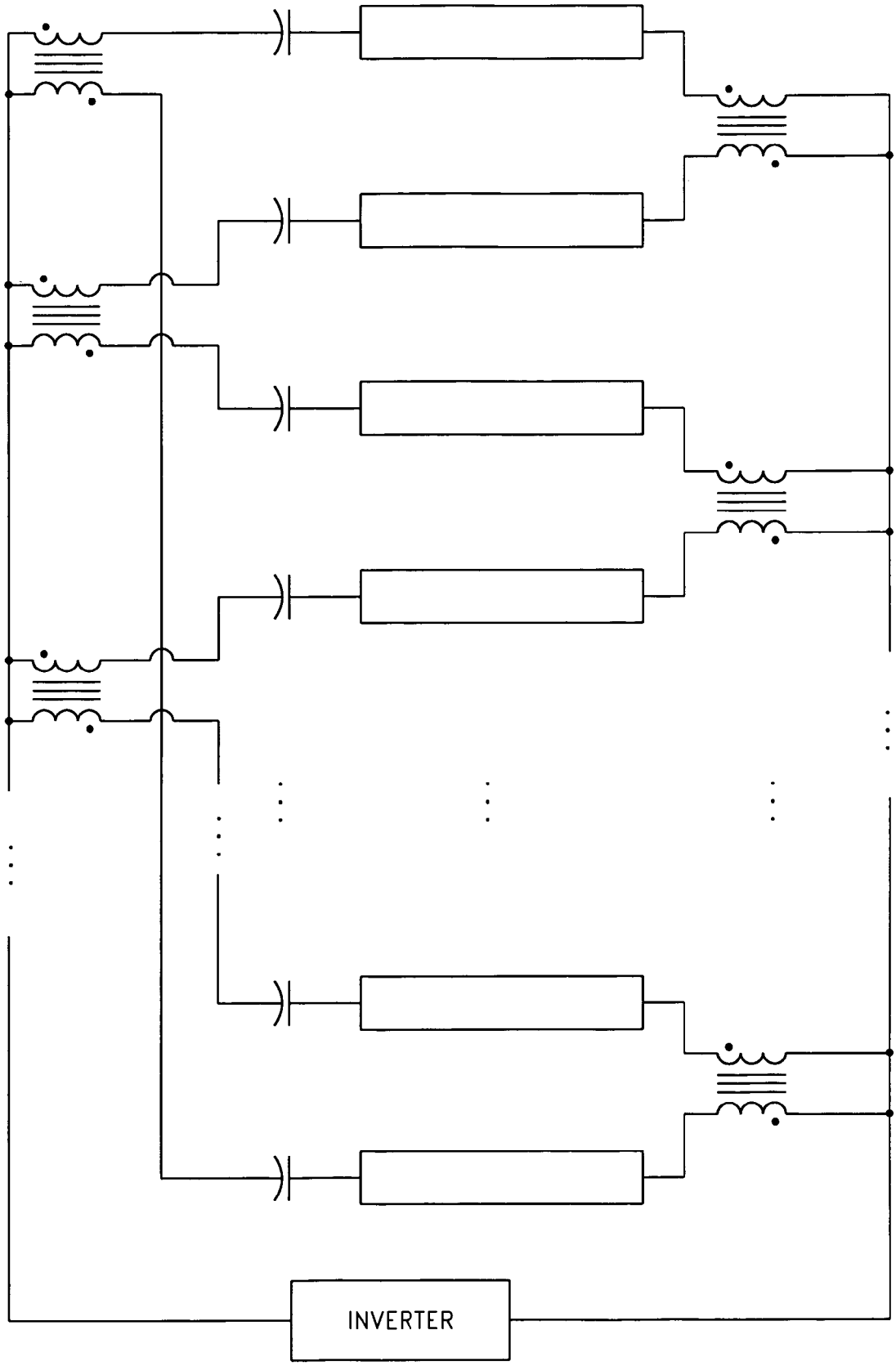
FIG. 9A illustrates a zigzag topology configuration of N gas-discharge lamps and N balancing transformers, which provides approximately the same leakage inductance to the lamps and provides additional suppression of electromagnetic interference (EMI), where N is even.

FIG. 6 illustrates an example with 3 lamps. FIGS. 7A and 7B illustrate examples with 4 lamps. FIG. 8 illustrates an example with N lamps, where N is an odd number. FIG. 9A illustrates an example with N lamps, where N is an even number.

As illustrated in the FIGS. 6 and 8, when N is an odd number, the configuration is asymmetric with an unequal number of balancing transformers on each side of the lamps. Further, at least one of the balancing transformers has balancing windings that are not electrically tied together. In addition, one of the ends of the of the side with the fewer number of balancing transformers is not tied to a balancing transformer. Nonetheless, the zigzag configurations with N lamps and N balancing transformers balance current effectively and with relatively well-matched leakage inductances in series with the lamps.

FIG. 6 illustrates a first lamp 602, a second lamp 604, and a third lamp 606. A first balancing transformer 608, a second balancing transformer 610, and a third balancing transformer 612 balance the currents flowing through the lamps 602, 604, 606. The first balancing transformer 608 balances current flowing through the first lamp 602 and the second lamp 604. The balancing windings of the first balancing transformer 608 remain separate, as one balancing winding is coupled to a first terminal of the inverter 102, and the other balancing winding is coupled to a winding of the third balancing transformer 612. It should be noted that these balancing windings are not commonly connected. In one embodiment, the first balancing transformer 608 also incorporates a safety winding that can be coupled to a protection circuit, a monitoring circuit, or both.

The second balancing transformer 610 balances the currents flowing through the second lamp 604 and the third lamp 606. The balancing windings of the second balancing transformer 610 are commonly connected at one end, so that the second balancing transformer can correspond to a two-way balancing transformer. It should be noted that, but for the common connection, which can be made outside of a transformer, substantially identical transformers can be used throughout the transformer configuration. In one embodiment, the second balancing transformer 610 further includes a safety winding and optionally further includes anti-parallel diodes to protect the second balancing transformer 610 from imbalances as described earlier in connection with FIG. 5.

The third balancing transformer 612 balances current flowing through the first lamp 602 and the third lamp 606. It should be noted that the third balancing transformer 612 can be considered extra or redundant for the purposes of current balancing. The balancing windings of the third balancing transformer 612 are also commonly connected at one end. Advantageously, each of the lamps 602, 604, 606 is in series with two balancing windings, which balances the leakage inductance in series with each lamp. In addition, the arrangement of lamps can optionally include capacitors 622, 624, 626 in series with the lamps to prevent direct current from passing through the lamps.

As illustrated in FIGS. 7 and 9, when N is an even number, the configuration can be symmetric with an equal number of balancing transformers on each side of the lamps. Moreover, each of the balancing transformers can correspond to a two-way balancing transformer with the balancing windings electrically commonly connected at one end. Further advantageously, when N is an even number, a balancing transformer is present at both ends of each of the lamps, which assists in the suppression of EMI.

FIG. 7A illustrates an embodiment with the zigzag topology with 4 lamps and 4 balancing transformers. The balancing transformers can correspond to two-way balancing transformers, as the balancing windings of each balancing transformer for an even number N are commonly connected at one end. The balancing windings can be wound from a single winding, internally connected, connected external to the transformer via a printed wiring board, an electrical harness, and the like.

FIG. 7A illustrates a first lamp 702, a second lamp 704, a third lamp 706, and a fourth lamp 708. As illustrated, a first balancing transformer 712, a second balancing transformer 714, a third balancing transformer 716, and a fourth balancing transformer 718 are arranged in a zigzag pattern. The first balancing transformer 712 balances the current flowing through the first lamp 702 and the second lamp 704. The second balancing transformer 714 balances current flowing through the second lamp 704 and the third lamp 706. The third balancing transformer 716 balances current flowing through the third lamp 706 and the fourth lamp 708. These transformers 712, 714, 716 by themselves can balance the current through the 4 lamps as described earlier in connection with FIG. 3.

An extra balancing transformer, here, the fourth balancing transformer 718 balances current flowing through the fourth lamp 708 and the first lamp 702. Also, the fourth balancing transformer 718 further balances the leakage inductance in series with the lamps 702, 704, 706. In addition, the fourth balancing transformer 718 provides leakage inductance at an end of the first lamp 702 and an end of the fourth lamp 708, which assists in the suppression of EMI. In addition, the arrangement of lamps can optionally include capacitors 722, 724, 726, 728 in series with the lamps 702, 704, 706, 708 to prevent direct current from passing through the lamps.

FIG. 7B illustrates an alternate embodiment of a zigzag topology configuration of 4 gas -discharge lamps and 4 balancing transformers. While the embodiments illustrated in FIGS. 7A and 7B are schematically identical, when viewed as layouts, FIGS. 7A and 7B illustrates that the layouts can be varied. Placing the lamps in the arrangement suggested by FIG. 7B results in wires with more uniform (or equal) lengths connecting the balancing transformers to the lamps. Other variations in placement will be readily determined by one of ordinary skill in the art.

Figure 9B:
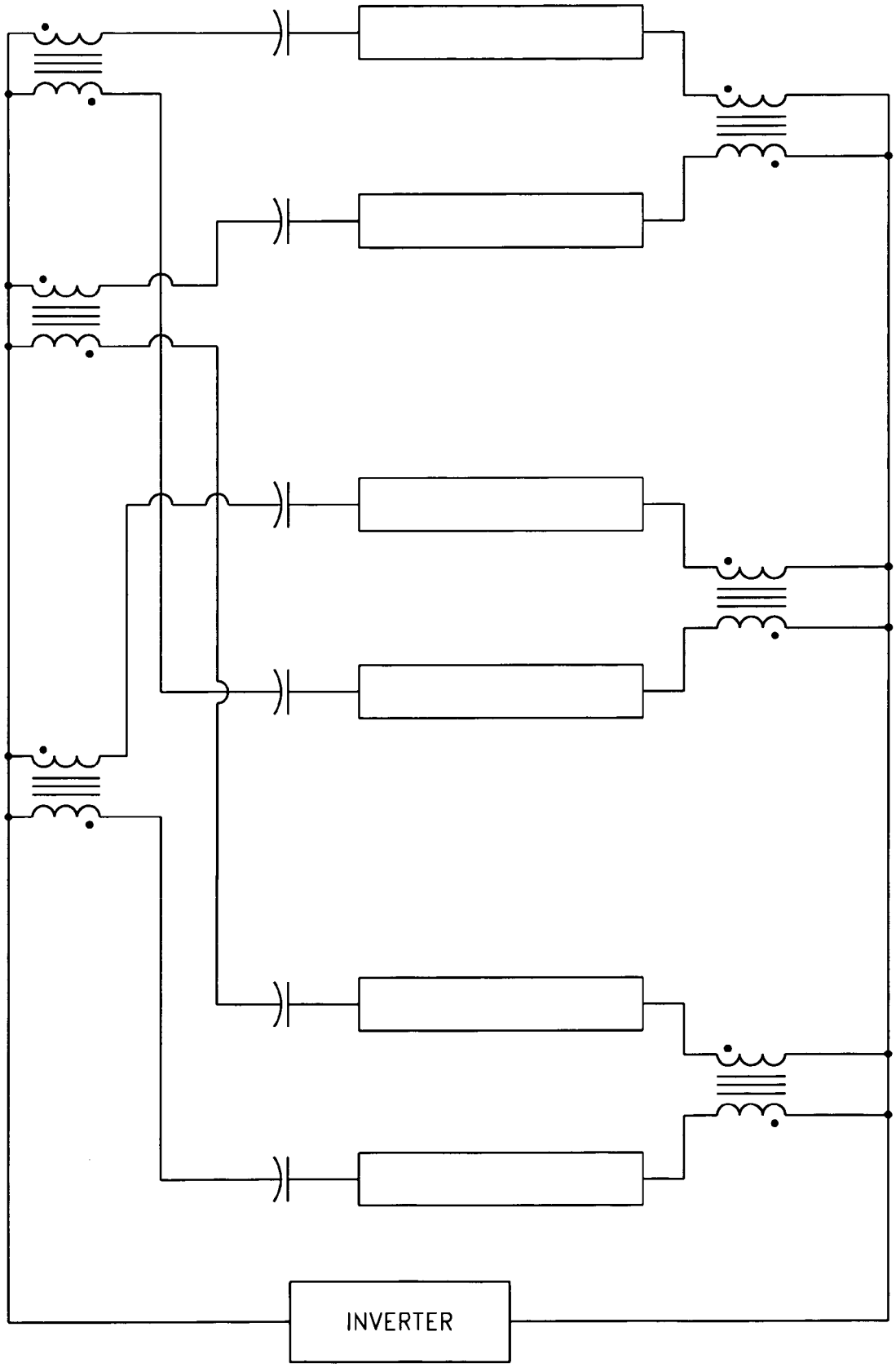
FIG. 9B illustrates another embodiment of a zigzag topology configuration of N gas-discharge lamps and N balancing transformers, with N equal to 6.

FIG. 8 illustrates an example of the zigzag topology with N lamps, where N is an odd number. FIG. 9A illustrates an example of the zigzag topology with N lamps, where N is an even number. FIG. 9B illustrates another embodiment of a zigzag topology with 6 gas-discharge lamps and 6 balancing transformers. Schematically, the embodiment illustrated in FIG. 9B is identical to the embodiment illustrated in FIG. 9A with N equal to 6. However, when viewed as layout diagrams, FIGS. 9A and 9B illustrate that the layouts can vary. For example, when viewed as layout diagrams, the embodiment illustrated in FIG. 9B has relatively more equal length wiring than the embodiment illustrated in FIG. 9A. Advantageously, the zigzag topology permits an arbitrary number of lamps to be driven in parallel.

Nested Balancing Topologies with N Lamp Groups of M Lamps

The various zigzag topologies describe above have been illustrated with reference to balancing current among multiple lamps. Similar zigzag topologies can be used to balance current among multiple groups of lamps (or lamp groups). For example, each of the lamps referenced in the above figures can represent a lamp group (or a lamp load) comprising of multiple lamps. The multiple lamps within a lamp group can be coupled in a serial configuration or a parallel configuration. In one embodiment, the lamp groups are arranged in a nested balancing topology with one set of balancing transformers balancing current among the lamp groups and additional sets of balancing transformers balancing current among lamps in each lamp group.

Figure 10:
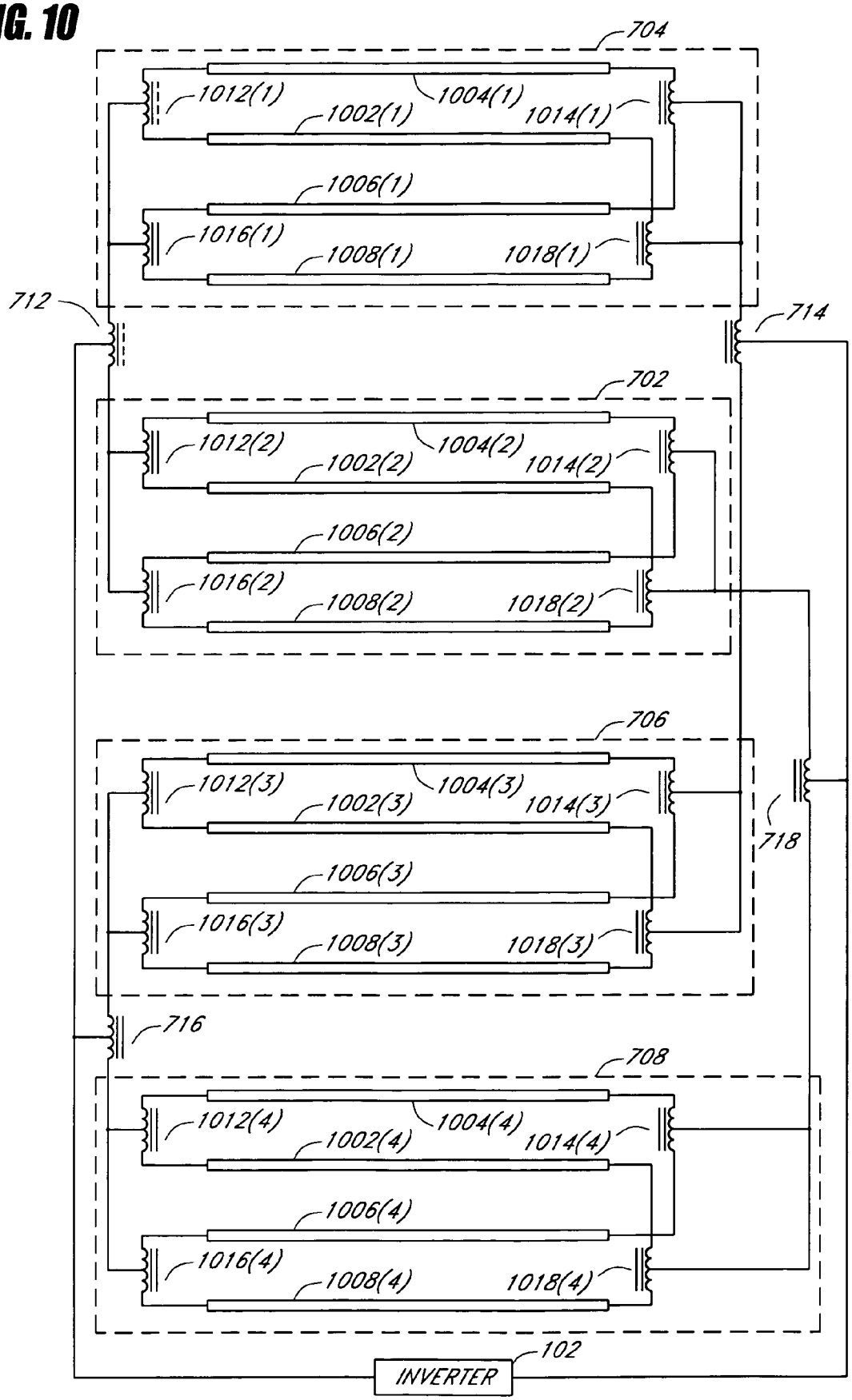
FIG. 10 illustrates one embodiment of N lamp groups of M lamps in a nested zigzag topology using closed zigzag configurations to balance current among the M lamps in each lamp group and to balance current among the N lamp groups.

FIG. 10 illustrates one embodiment of N lamp groups of M lamps in a nested zigzag topology using closed zigzag configurations to balance current among the M lamps in each lamp group and to balance current among the N lamp groups. In the embodiment illustrated in FIG. 10, 16 lamps are organized into four lamp groups of four lamps. A set of four balancing transformers (or outer-level balancing transformers) are coupled to the lamp groups in a closed zigzag configuration to balance current among the four lamp groups. Each lamp group has a dedicated set of four balancing transformers (or inner-level balancing transformers) coupled to the lamps in a closed zigzag configuration to balance current among the lamps within the same lamp group.

The closed zigzag configurations used to balance current among the four lamps within each lamp group and among the four lamp groups are substantially similar to the configuration shown in FIG. 7B. FIG. 7B illustrates optional capacitors 722, 724, 726, 728 coupled in series with each lamp. Optional capacitors can also be included in the embodiment shown in FIG. 10. For example, an optional capacitor can be coupled in series with each lamp or each lamp group to block DC current. However, optional capacitors are not shown in FIG. 10 for clarity of illustration.

In one embodiment, the outer-level balancing transformers and the inner-level balancing transformers are two-way balancing transformers comprised of two balance windings with a common input terminal and two separate output terminals. The inner-level balancing transformers and the outer-level balancing transformers can be constructed in a similar manner with the outer-level balancing transformers designed to conduct more current (or have a higher current rating) than the inner-level balancing transformers. The outer-level balancing transformers are advantageously substantially identical to each other and the inner-level balancing transformers are advantageously substantially identical to each other.

In the embodiment shown in FIG. 10, a first outer-level balancing transformer 712 and a second outer-level balancing transformer 716 have respective input terminals coupled to a first output of an inverter 102. A third outer-level balancing transformer 714 and a fourth outer-level balancing transformer 718 have respective input terminals coupled to a second output of the inverter 102. The first outer-level balancing transformer 712 has output terminals coupled to respective first group ends of a first set of two lamp groups (i.e., a first lamp group 704 and a second lamp group 702) to balance current between the first lamp group 704 and the second lamp group 702. The second outer-level balancing transformer 716 has output terminals coupled to respective first group ends of a second set of two lamp groups (i.e., a third lamp group 706 and a fourth lamp group 708). The third outer-level balancing transformer 714 has output terminals coupled to respective second group ends of a third set of two lamp groups (i.e., the first lamp group 704 and the third lamp group 706). The fourth outer-level balancing transformer 718 has output terminals coupled to respective second group ends of a fourth set of two lamp groups (i.e., the second lamp group 702 and the fourth lamp group 708).

The first set of two lamp groups and the third set of two lamp groups partially overlap with the first lamp group 704 common to both sets. The second set of two lamp groups and the third set of two lamp groups partially overlap with the third lamp group 706 common to both sets. These partial overlaps facilitate balanced currents among the four lamp groups 702, 704, 706, 708 using two-way balancing transformers. The fourth outer-level balancing transformer 718 provides additional partially overlapping sets of two lamp groups. Furthermore, the fourth outer-level balancing transformer 718 facilitates better symmetry (e.g., balanced leakage inductance) with each group end coupled to an outer-level balancing transformer.

As discussed above, each of the lamp groups has four inner-level balancing transformers coupled to lamps of that lamp group in a closed zigzag configuration to balance current among the lamps. The inner-level balancing transformers are coupled to partially overlapping pairs of lamps at alternating ends of the lamps. Referring to the first lamp group 704, a first inner-level balancing transformer 1012(1) and a second inner-level balancing transformer 1016(1) have input terminals coupled to the first group end of the first lamp group 704. A third inner-level balancing transformer 1014(1) and a fourth inner-level balancing transformer 1018 (1) have input terminals coupled to the second group end of the first lamp group 704. The first inner-level balancing transformer 1012(1) has output terminals coupled to respective first ends of a first lamp 1004(1) and a second lamp 1002(1). The second inner-level balancing transformer 1016 (1) has output terminals coupled to respective first ends of a third lamp 1006(1) and a fourth lamp 1008(1). The third inner-level balancing transformer 1014(1) has output terminals coupled to respective second ends of the first lamp 1004(1) and the third lamp 1006(1). Finally, the fourth inner-level balancing transformer 1018(1) has output terminals coupled to respective second ends of the second lamp 1002(1) and the fourth lamp 1008(1). Inner-level balancing transformers are similarly coupled to lamps in the other lamp groups to balance current among lamps of the same lamp group.

Figure 11:
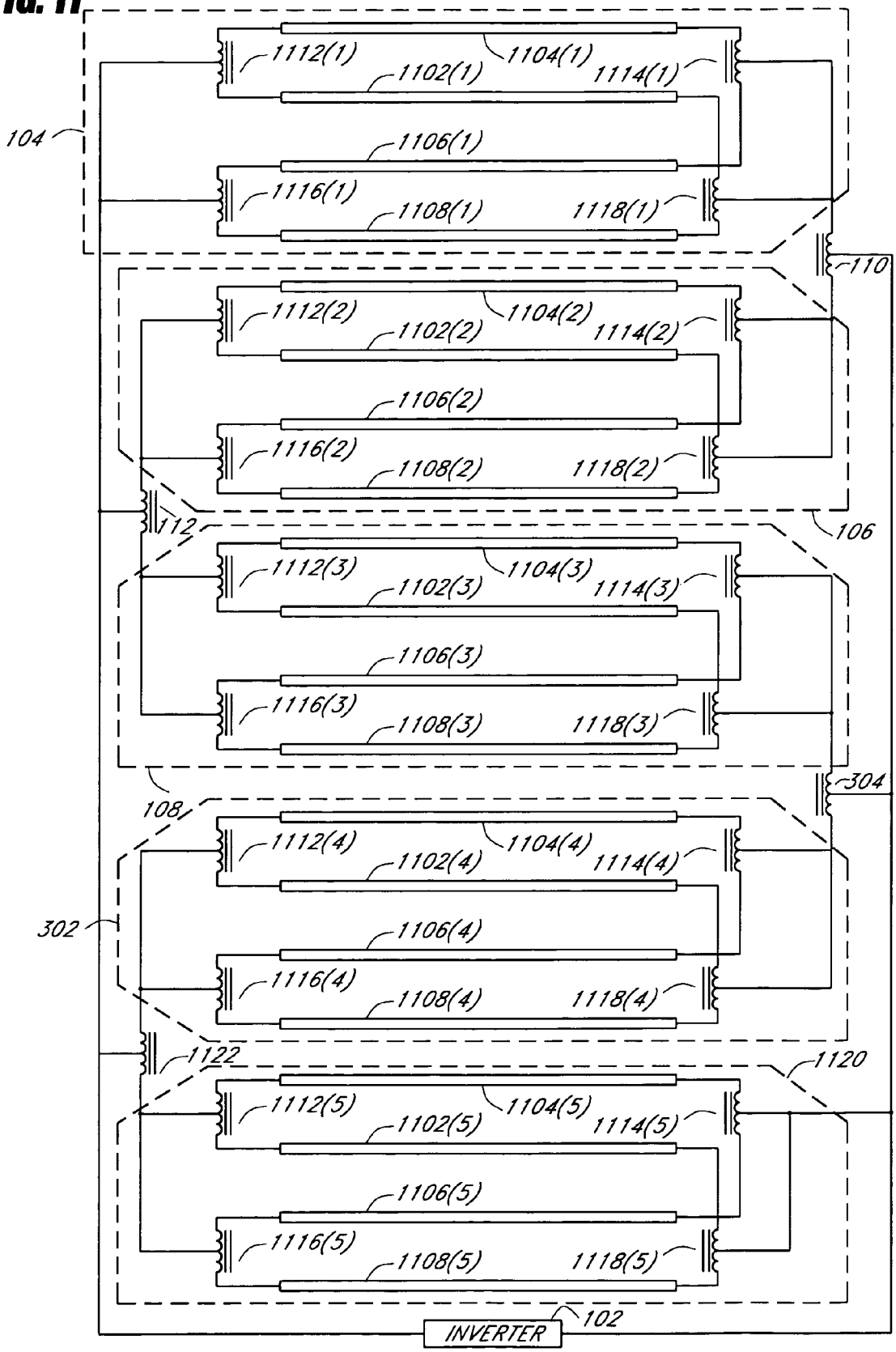
FIG. 11 illustrates another embodiment of N lamp groups of M lamps in a nested zigzag topology using closed zigzag configurations to balance current among the M lamps in each lamp group and an open zigzag configuration to balance current among the N lamp groups.

FIG. 11 illustrates another embodiment of N lamp groups of M lamps in a nested zigzag topology using closed zigzag configurations to balance current among the M lamps in each lamp group and an open zigzag configuration to balance current among the N lamp groups. In the embodiment illustrated in FIG. 11, 20 lamps are organized into five lamp groups of four lamps. Each lamp group includes a set of four inner-level balancing transformers coupled to the lamps in a closed zigzag configuration to balance current among the lamps within the same lamp group. The closed zigzag configuration illustrated in FIG. 11 is substantially similar to the closed zigzag configurations illustrated in FIG. 10 and is not discussed in further detail.

FIG. 11 shows a set of four outer-level balancing transformers coupled to the five lamp groups in an open zigzag configuration to balance current among the five lamp groups. The open zigzag configuration shown in FIG. 11 is substantially similar to the configuration shown in FIG. 4. FIG. 4 includes optional capacitors which are not shown in FIG. 11 for clarity of illustration. In the embodiment shown in FIG. 11, a second outer-level balancing transformer 112 and a fourth outer-level balancing transformer 1122 have respective input terminals coupled to a first output of an inverter 102. A first outer-level balancing transformer 110 and a third outer-level balancing transformer 304 have respective input terminals coupled to a second output of the inverter 102.

The outer-level balancing transformers 110, 112, 304, 1122 are coupled at alternating group ends of partially overlapping sets of two lamp groups to balance current among the five lamp groups. For example, the first outer-level balancing transformer 110 has output terminals coupled to respective second group ends of a first set of two lamp groups (i.e., a first lamp group 104 and a second lamp group 106). The second outer-level balancing transformer 112 has output terminals coupled to respective first group ends of a second set of two lamp groups (i.e., the second lamp group 106 and a third lamp group 108). The third outer-level balancing transformer 304 has output terminals coupled to respective second group ends of a third set of two lamps groups (i.e., the third lamp group 108 and a fourth lamp group 302). The fourth outer-level balancing transformer 1122 has output terminals coupled to respective first group ends of a fourth set of two lamp groups (i.e., the fourth lamp group 302 and a fifth lamp group 1120).

A lamp group that is common to two sets of two lamp groups has an outer-level balancing transformer at each group end. For example, the second lamp group 106 is coupled to the second outer-level balancing transformer 112 at its first group end and to the first outer-level balancing transformer at its second group end. The third lamp group 108 and the fourth lamp group 302 similarly have outer-level balancing transformers at both group ends.

Figure 12:
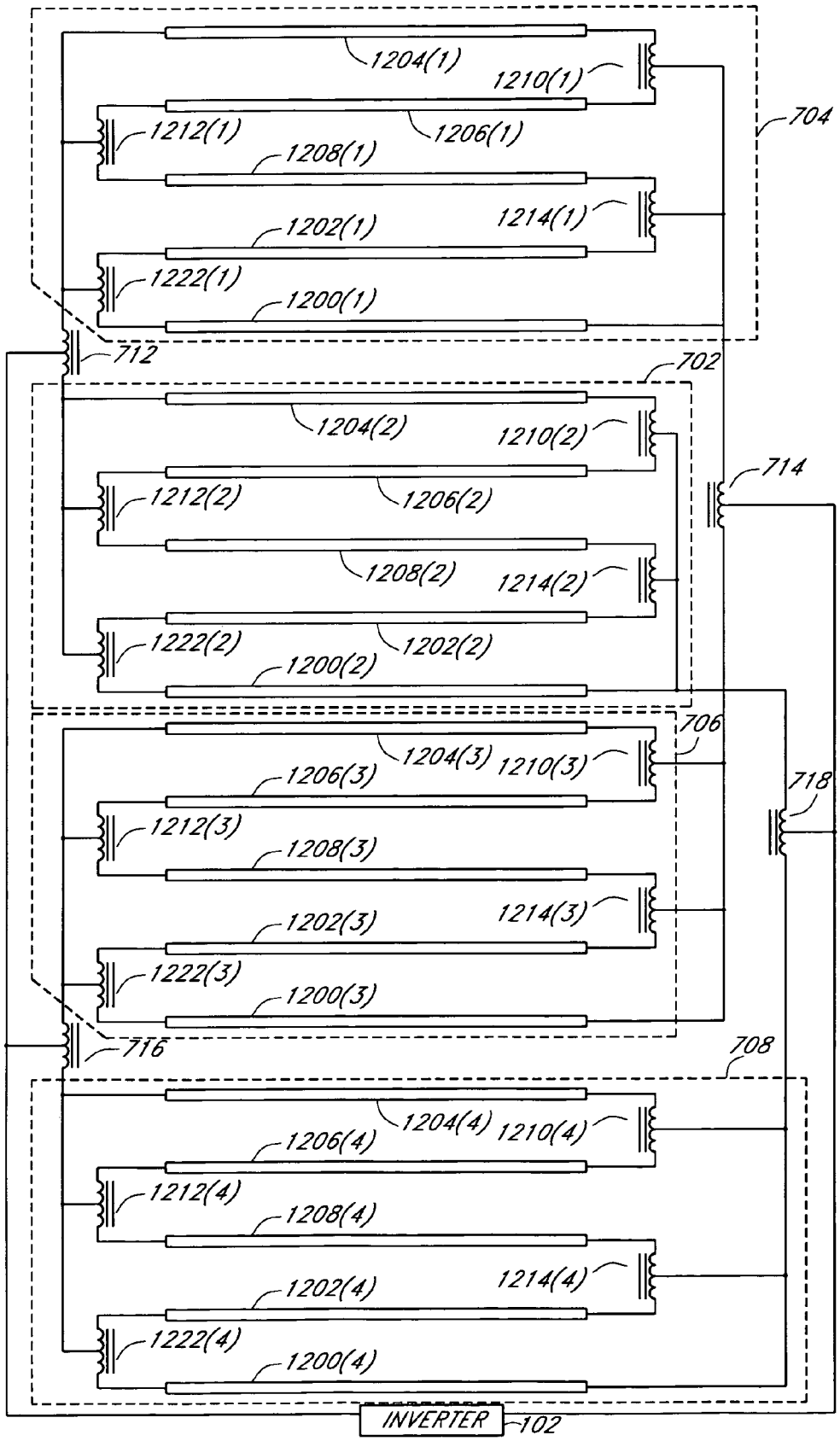
FIG. 12 illustrates yet another embodiment of N lamp groups of M lamps in a nested zigzag topology using open zigzag configurations to balance current among the M lamps in each lamp group and a closed zigzag configuration to balance current among the N lamp groups.

FIG. 12 illustrates yet another embodiment of N lamp groups of M lamps in a nested zigzag topology using open zigzag configurations to balance current among the M lamps in each lamp group and a closed zigzag configuration to balance current among the N lamp groups. In the embodiment illustrated in FIG. 12, 20 lamps are organized into four lamp groups of five lamps. A set of four outer-level balancing transformers are coupled to the four lamp groups in a closed zigzag configuration to balance current among the four lamp groups. The closed zigzag configuration shown in FIG. 12 is substantially similar to the closed zigzag configuration shown in FIG. 10 and is not discussed in further detail.

In the embodiment illustrated in FIG. 12, each lamp group has a set of four inner-level balancing transformers coupled to lamps of that lamp group in an open zigzag configuration to balance current among the lamps. Referring to a first lamp group 704, a first inner-level balancing transformer 1210(1) and a third inner-level balancing transformer 1214(1) have respective input terminals coupled to a second group end of the first lamp group 704. A second inner-level balancing transformer 1212(1) and a fourth inner-level balancing transformer 1222(1) have respective input terminals coupled to a first group end of the first lamp group 704.

The inner-level balancing transformers 1210(1), 1212(1), 1214(1), 1222(1) are coupled at alternating ends of partially overlapping pairs of lamps to balance current among the five lamps in the first lamp group 704. For example, the first inner-level balancing transformer 1210(1) has output terminals coupled to respective second ends of a first lamp 1204(1) and a second lamp 1206(1). The second inner-level balancing transformer 1212(1) has output terminals coupled to respective first ends of the second lamp 1206(1) and a third lamp 1208(1). The third inner-level balancing transformer 1214(1) has output terminals coupled to respective second ends of the third lamp 1208(1) and a fourth lamp 1202(1). Finally, the fourth inner-level balancing transformer 1222(1) has output terminals coupled to respective first ends of the fourth lamp 1202(1) and a fifth lamp 1200(1). Inner-level balancing transformers are similarly coupled to lamps in the other lamp groups to balance current among lamps of the same lamp group.

The nested zigzag topologies described in FIGS. 10–12 are illustrative only and are not intended to be exclusive or limiting. For example, the number of lamps or lamp groups can be varied. In addition, the levels of nesting can be increased to more than two levels. Different, combinations of open zigzag configurations and closed zigzag configurations can also be used to balance current among lamps of the same lamp group or to balance current among multiple lamp groups. For example, one application uses nested open zigzag configurations to balance current among lamp groups and to balance current among lamps within each lamp group. Other applications use a mix of open zigzag configurations and closed zigzag configurations to balance current among lamps in each lamp group or among the lamp groups.

It is also possible to combine other balancing configurations in a nested topology to balance current among multiple lamp groups and to balance current among lamps within each lamp group. For example, ring balancing topologies, string balancing topologies, tree balancing topologies, and the like can also be used to balance current among multiple lamps or lamp groups. In the ring balancing topologies, a set of balancing transformers have secondary windings coupled in series and in a closed loop to conduct a common current while primary windings are individually coupled in series with a lamp or lamp group. In the string balancing topologies, balancing transformers are coupled to overlapping pairs of lamps or lamp groups at one end. In the tree balancing topologies, a hierarchical arrangement of balancing transformers is used with first level balancing transformers dividing current in a balanced manner from single current paths to two current paths, second level balancing transformers dividing the two current paths into at least four balanced current paths, and possible subsequent levels of balancing transformers to further increase the number of balanced current paths. Further details of the tree balancing topologies can be found in commonly-owned pending U.S. application Ser. No. 10/970,243, entitled "Systems and Methods for a Transformer Configuration with a Tree Topology for Current Balancing in Gas Discharge Lamps," which is hereby incorporated by reference herein.

Figure 13:
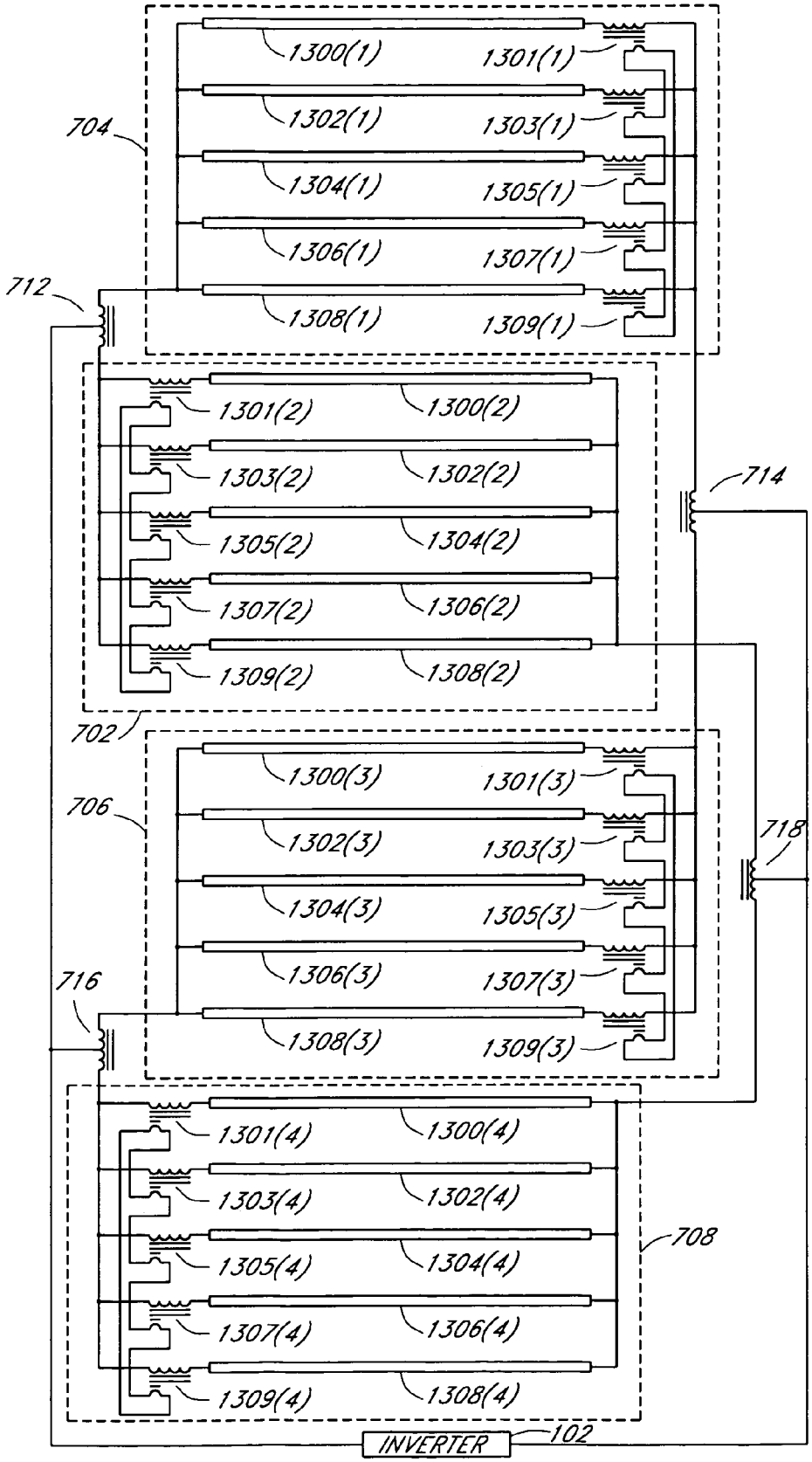
FIG. 13 illustrates one embodiment of N lamp groups of M lamps in a nested balancing topology using ring balancing configurations to balance current among the M lamps in each lamp group and a closed zigzag configuration to balance current among the N lamp groups.

FIG. 13 illustrates one embodiment of N lamp groups of M lamps in a nested balancing topology using ring balancing configurations to balance current among the M lamps in each lamp group and a closed zigzag configuration to balance current among the N lamp groups. In the embodiment illustrated in FIG. 13, 20 lamps are organized into four lamp groups of five lamps. A set of four outer-level balancing transformers is coupled to the four lamp groups in a closed zigzag configuration to balance current among the four lamp groups. The closed zigzag configuration shown in FIG. 13 is substantially similar to the closed zigzag configuration shown in FIG. 10 and is not discussed in further detail.

In the embodiment illustrated in FIG. 13, each lamp group has a set of five inner-level balancing transformers coupled to lamps of that lamp group in a ring balancing configuration to balance current among the lamps. Referring to a first lamp group 704, five lamps 1300(1), 1302(1), 1304(1), 1306(1) 1308(1) have first ends commonly connected to a first group end of the first lamp group 704. A first inner-level balancing transformer 1301(1) has a primary winding coupled between a second end of the first lamp 1300(1) and a second group end of the first lamp group 704. A second inner-level balancing transformer 1303(1) has a primary winding coupled between a second end of the second lamp 1302(1) and the second group end. A third inner-level balancing transformer 1305(1) has a primary winding coupled between a second end of the third lamp 1304(1) and the second group end. A fourth inner-level balancing transformer 1307(1) has a primary winding coupled between a second end of the fourth lamp 1306(1) and the second group end. Finally, a fifth inner-level balancing transformer 1309(1) has a primary winding coupled between a second end of the fifth lamp 1308(1) and the second group end.

Secondary windings of the first set of inner-level balancing transformers 1301(1), 1303(1), 1305(1), 1307(1), 1309 (1) are coupled in a serial loop. The serial loop allows a common current to circulate in the secondary windings and the respective primary windings conduct currents that are proportional to the common current, thereby balancing current among the lamps 1300(1), 1302(1), 1304(1), 1306(1) 1308(1) in the first lamp group 704. In one embodiment, the secondary windings are single turn windings. Further details of the ring balancing configuration and balancing transformers used in the ring balancing configurations can be found in commonly-owned pending U.S. application Ser. No. 10/958,668, entitled "A Current Sharing Scheme for Multiple CCF Lamp Operation," and U.S. application Ser. No. 10/959,667, entitled "Balancing Transformers for Ring Balancer," which are hereby incorporated by reference herein.

Ring balancing configurations are also used to balance current among lamps in the other lamp groups shown in FIG. 13. For example, a second lamp group 702 has a second set of five inner-level balancing transformers 1301(2), 1303(2), 1305(2), 1307(2), 1309(2) coupled in a ring balancing configuration between a first group end of the second lamp group 702 and first ends of lamps 1300(2), 1302(2), 1304(2), 1306(2) 1308(2) in the second lamp group 702. A third lamp group 706 has a third set of five inner-level balancing transformers 1301(3), 1303(3), 1305(3), 1307(3), 1309(3) coupled in a ring balancing configuration between a second group end of the third lamp group 706 and second ends of lamps 1300(3), 1302(3), 1304(3), 1306(3) 1308(3) in the third lamp group 704. A fourth lamp group 708 has a fourth set of five inner-level balancing transformers 1301(4), 1303(4), 1305(4), 1307(4), 1309(4) coupled in a ring balancing configuration between a first group end of the fourth lamp group 708 and first ends of lamps 1300(4), 1302(4), 1304(4), 1306(4) 1308(4) in the fourth lamp group 708.

A secondary function of a balancing transformer is filtering. High harmonics of the fundamental driving frequency and high frequency noise are attenuated by a combination of leakage inductance of the balancing transformer and capacitance to chassis of lamp plasma. When a relatively long lamp has a balancing transformer at one end, the end without a balancing transformer is expected to be brighter due to high frequency current. For example, if long lamps are used in the embodiment of FIG. 13, the lamps in the first lamp group 704 and the third lamp group 706 are expected to be brighter near the first ends of the lamps while the lamps in the second lamp group 702 and the fourth lamp group 708 are expected to be brighter near the second ends of the lamps.

Figure 14:
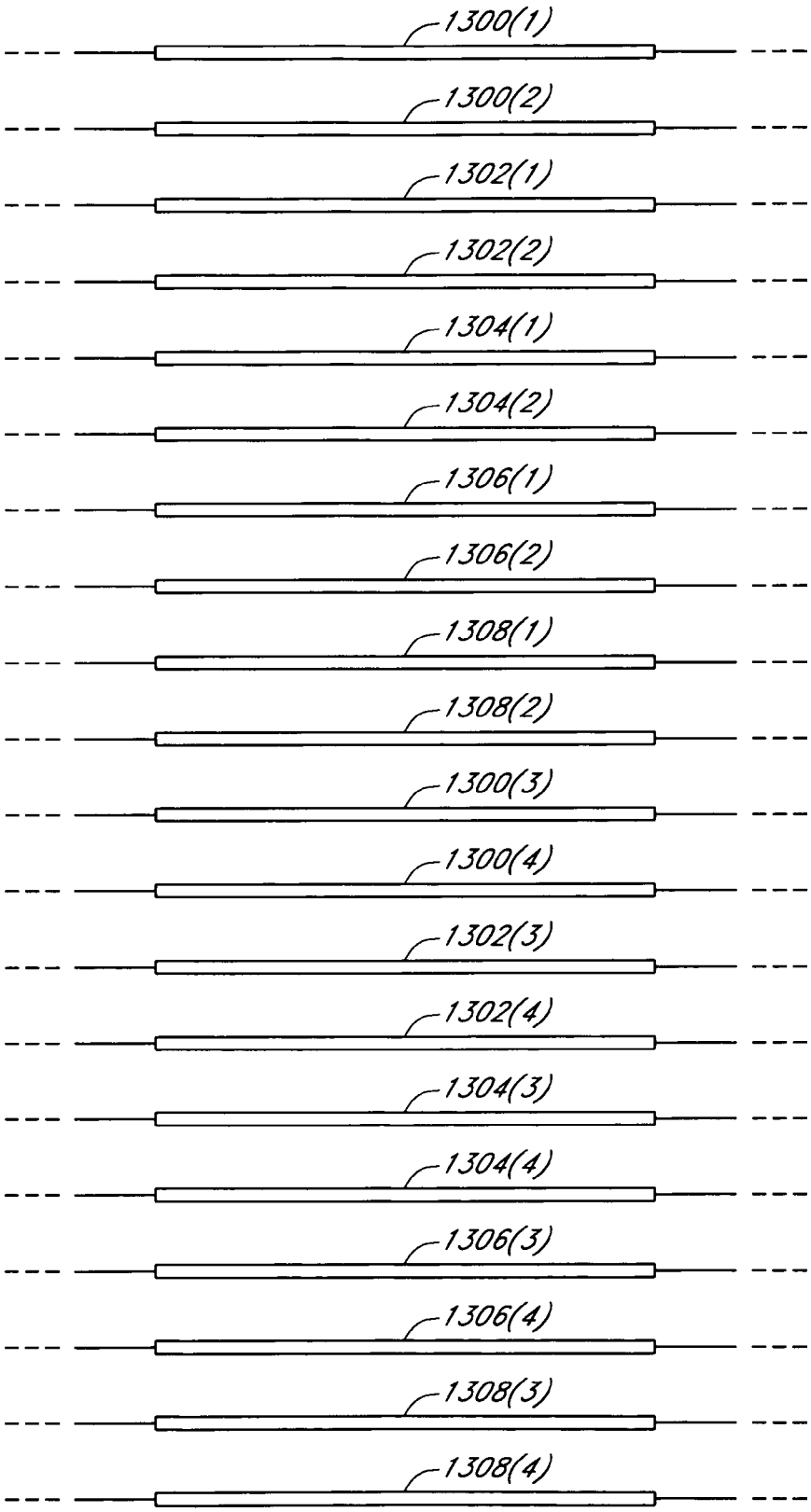
FIG. 14 illustrates one embodiment of interleaving lamps from different lamp groups in a display panel to reduce uneven brightness.

One technique for reducing uneven brightness is to use balancing configurations that include balancing transformers at both ends of a lamp. Another technique to reduce uneven brightness is to place lamps in a display panel such that adjacent lamps have balancing transformers at alternate ends. For example, FIG. 14 illustrates one embodiment of interleaving lamps from different lamp groups in a display panel to reduce uneven brightness. FIG. 14 illustrates one possible placement of lamps shown in FIG. 13. The lamps 1300(1), 1302(1), 1304(1), 1306(1) 1308(1) from the first lamp group 704 are interleaved with the lamps 1300(2), 1302(2), 1304(2), 1306(2) 1308(2) from the second lamp group 702, and the lamps 1300(3), 1302(3), 1304(3), 1306(3) 1308(3) from the third lamp group 706 are interleaved with the lamps 1300(4), 1302(4), 1304(4), 1306(4) 1308(4) from the fourth lamp group 708. Adjacent lamps have balancing transformers at alternate ends of the lamps. The balancing transformers and circuit connections are not shown for clarity of illustration.

Various embodiments have been described above. Although described with reference to these specific embodiments, the descriptions are intended to be illustrative and are not intended to be limiting. Various modifications and applications may occur to those skilled in the art without departing from the true spirit and scope of the invention as defined by the appended claims.

What is claimed is:

1. A multi-lamp assembly comprising:

N lamp groups, wherein N is at least three and each lamp group comprises at least two lamps arranged in a lamp subassembly that is coupled between two group ends; and at least N−1 outer-level balancing transformers, wherein each outer-level balancing transformer comprises two balance windings configured for coupling to two different lamp groups to balance current between the two different lamp groups and the N−1 outer-level balancing transformers are respectively coupled to N−1 partially overlapping sets of two lamp groups in a zigzag configuration such that each lamp group is coupled to at least one outer-level balancing transformer and each group end of at least N−2 lamp groups is coupled to an outer-level balancing transformer.

2. The multi-lamp assembly of claim 1, further comprising an additional outer-level balancing transformer configured for coupling to two of the N lamp groups such that each group end of the N lamp groups is coupled to an outer-level balancing transformer.

3. The multi-lamp assembly of claim 1, wherein at least one lamp group further comprises one or more inner-level balancing transformers configured to balance current among lamps in the same lamp group.

4. The multi-lamp assembly of claim 3, wherein M lamps of the same lamp group are coupled to at least M−1 inner-level balancing transformers in a zigzag configuration.

5. The multi-lamp assembly of claim 3, wherein M lamps of the same lamp group are coupled to M respective inner-level balancing transformers arranged in a ring balancing configuration such that each lamp is coupled in series with a primary winding of a different inner-level balancing transformer and secondary windings of the M inner-level balancing transformers are coupled in a serial loop.

6. The multi-lamp assembly of claim 1, wherein N is five, each of the five lamp groups comprises four fluorescent lamps and four inner-level balancing transformers, and four outer-level balancing transformers are coupled to the five lamp groups in a zigzag configuration with a first outer-level balancing transformer coupled to first group ends of a first lamp group and a second lamp group, a second outer-level balancing transformer coupled to second group ends of the second lamp group and a third lamp group, a third outer-level balancing transformer coupled to first group ends of the third lamp group and a fourth lamp group, and a fourth outer-level balancing transformer coupled to second group ends of the fourth lamp group and a fifth lamp group.

7. The multi-lamp assembly of claim 1, wherein N is four and four outer-level balancing transformers balance current among the four lamp groups with a first outer-level balancing transformer coupled to first group ends of a first lamp group and a second lamp group, a second outer-level balancing transformer coupled to first group ends of a third lamp group and a fourth lamp group, a third outer-level balancing transformer coupled to second group ends of the first lamp group and the third lamp group, and a fourth outer-level balancing transformer coupled to second group ends of the second lamp group and the fourth lamp group.

8. The multi-lamp assembly of claim 7, wherein each lamp group comprises four lamps and four inner-level balancing transformers arranged in a closed zigzag configuration with a first inner-level balancing transformer coupled to first terminals of a first lamp and a second lamp, a second inner-level balancing transformer coupled to second terminals of the second lamp and a fourth lamp, a third inner-level balancing transformer coupled to first terminals of the fourth lamp and a third lamp, and a fourth inner-level balancing transformer coupled to second terminals of the third lamp and the first lamp.

9. The multi-lamp assembly of claim 7, wherein each lamp group comprises five lamps and four inner-level balancing transformers arranged in an open zigzag configuration with a first inner-level balancing transformer coupled to first terminals of a first lamp and a second lamp, a second inner-level balancing transformer coupled to second terminals of the second lamp and a third lamp, a third inner-level balancing transformer coupled to first terminals of the third lamp and a fourth lamp,- and a fourth inner-level balancing transformer coupled to second terminals of the fourth lamp and a fifth lamp.

10. The multi-lamp assembly of claim 7, wherein each lamp group comprises five lamps coupled to five inner-level balancing transformers in a ring balancing configuration with first lamp terminals commonly connected, second lamp terminals of the respective lamps individually coupled in series with primary windings of the respective inner-level balancing transformers, and secondary windings of the inner-level balancing transformers coupled in serial loop.

11. A method to balance current among multiple groups of lamps, the method comprising:

grouping a plurality of lamps into N lamp groups, wherein each lamp group comprises at least two lamps arranged in a lamp subassembly that is coupled between two group ends; and coupling N−1 outer-level balancing transformers to N−1 partially overlapping sets of two lamp groups in a zigzag configuration to balance current among the N lamp groups, wherein each outer-level balancing transformer comprises two balance windings for coupling to two different lamp groups, each lamp group is coupled to at least one outer-level balancing transformer and at least N−2 lamp groups are each coupled to two different outer-level balancing transformers at opposite group ends.

12. The method of claim 11, further comprising using one or more inner-level balancing transformers to balance current among lamps in the same lamp group.

13. The method of claim 11, wherein each lamp group comprises M lamps coupled to at least M−1 inner-level balancing transformers in a zigzag configuration.

14. The method of claim 13, wherein the outer-level balancing transformers are substantially identical to each other and the inner-level balancing transformers are substantially identical to each other.

15. The method of claim 11, further comprising balancing each lamp group of M lamps with M inner-level balancing transformers arranged in a ring balancing configuration with secondary windings coupled in a serial closed loop and primary windings individually coupled in series with each lamp.

16. The method of claim 15, further comprising interleaving the lamps of two different lamp groups in a display panel such that adjacent lamps have respective inner-level balancing transformers at opposite ends of the lamps.

17. A multi-lamp assembly comprising:

means for forming N lamp groups, wherein each lamp group comprises at least two lamps arranged in a lamp subassembly that is coupled between two group ends; and means for balancing current among the N lamp groups by coupling N−1 balancing transformers to N−1 partially overlapping sets of two lamp groups at alternating group ends.

18. The multi-lamp assembly of claim 17, wherein each lamp group comprises one or more inner-level balancing transformers configured to balance current among lamps in the same lamp group.

19. The multi-lamp assembly of claim 17, wherein each lamp group comprises M lamps and at least M−1 inner-level balancing transformers arranged in a zigzag configuration.

20. The multi-lamp assembly of claim 17, wherein the lamps are cold cathode fluorescent lamps used for backlighting a liquid crystal display.

* * * * *

UNITED STATES PATENT AND TRADEMARK OFFICE

CERTIFICATE OF CORRECTION

PATENT NO. : 7,173,382 B2
APPLICATION NO. : 11/095313
DATED : February 6, 2007
INVENTOR(S) : Newton E. Ball It is certified that error appears in the above-identified patent and that said Letters Patent is hereby corrected as shown below:

At Column 1, Line 40, after "relatively" delete "few-" and insert -- few --, therefor.
At Column 7, Line 7, delete "gas -discharge" and insert -- gas-discharge --, therefor.
At Column 8, Line 24, delete "By." and insert -- By --, therefor.
At Column 11, Line 31 (Approx.) after "4" delete "gas -discharge" and insert -- gas-discharge --, therefor.
At Column 14, Line 24, delete "gas -discharge" and insert -- gas-discharge --, therefor.
At Column 21, Line 16, in Claim 9, delete "- and" and insert -- and --, therefor.

Signed and Sealed this

Twelfth Day of June, 2007

JON W. DUDAS
*Director of the United States Patent and Trademark Office*